US007415748B1

(12) United States Patent
Guhr et al.

(10) Patent No.: US 7,415,748 B1
(45) Date of Patent: Aug. 26, 2008

(54) VACUUM IMPLEMENT FOR USE WITH A SKID STEER

(75) Inventors: Troy Devan Guhr, Central, SC (US); John William Gilman, Greer, SC (US); Charles Robert Maybury, Jr., Greer, SC (US)

(73) Assignee: McLaughlin Group, Inc., Greenville, SC (US)

( * ) Notice: Subject to any disclaimer, the term of this patent is extended or adjusted under 35 U.S.C. 154(b) by 387 days.

(21) Appl. No.: 10/959,384

(22) Filed: Oct. 6, 2004

Related U.S. Application Data

(60) Provisional application No. 60/538,395, filed on Jan. 22, 2004.

(51) Int. Cl.
*A47L 5/00* (2006.01)
*E01H 1/08* (2006.01)

(52) U.S. Cl. ..... 15/340.1; 172/4.5; 414/722

(58) Field of Classification Search ..... None
See application file for complete search history.

(56) References Cited

U.S. PATENT DOCUMENTS

| | | | | |
|---|---|---|---|---|
| 5,515,625 | A | 5/1996 | Keigley | 37/405 |
| D423,521 | S | 4/2000 | Walter et al. | D15/23 |
| 6,360,458 | B2 | 3/2002 | Dolister | 37/195 |
| 6,397,967 | B1 | 6/2002 | McIlwraith | 180/308 |
| 6,499,934 | B1 | 12/2002 | Kaczmarski et al. | 414/723 |
| 6,550,406 | B2 | 4/2003 | Bass et al. | 111/100 |
| 2006/0032095 | A1 * | 2/2006 | Buckner | 37/304 |
| 2006/0182591 | A1 * | 8/2006 | Hackett et al. | 414/685 |

OTHER PUBLICATIONS

Equipment World Article-Sep. 2003; SerVac Brochure; and RockVac Brochure.

* cited by examiner

*Primary Examiner*—David A Redding
(74) *Attorney, Agent, or Firm*—Nelson Mullins Riley & Scarborough, LLP

(57) ABSTRACT

A portable vacuum implement for use with a skid steer vehicle has a frame, a skid steer mounting saddle coupled to the frame and a motor mounted to the frame. A vacuum pump mounted on the frame is coupled to the motor so that the motor drives the vacuum pump. A collection tank mounted on the frame is coupled to the vacuum pump so that the vacuum pump pulls a vacuum through the collection tank. A vacuum head is connected to the collection tank by a first hose for vacuuming debris at an excavation site.

5 Claims, 17 Drawing Sheets

VACUUM IMPLEMENT FOR USE WITH A SKID STEER

CLAIM OF PRIORITY

This non-provisional patent application claims priority to U.S. Provisional Patent Application No. 60/538,395 filed Jan. 22, 2004, the entire disclosure of which is incorporated by reference herein.

FIELD OF THE INVENTION

The present invention relates generally to skid steer work implements. More particularly, the present invention relates to a vacuum excavating and slurry collection system for attachment to a skid steer vehicle.

BACKGROUND OF THE INVENTION

In known truck or trailer vacuum systems, components of the vacuum system are hard mounted to the truck or trailer. Thus, the purchase of such a system includes the truck or trailer. Additionally, truck or trailer mounted systems are relatively large and cumbersome, making them inaccessible to many work sites. To use such a system at a work site where there is little room, many obstructions and/or difficult terrain, the truck or trailer is typically left on an access street, and extension hoses are used to bring the vacuum head to an excavation area at the work site. The use of extension hoses, however, can reduce the vacuum system's efficiency and effectiveness.

Skid steer loaders, including front end loaders, are commonly used vehicles for many industrial, agricultural and landscaping operations. Skid steer and front end loaders generally come in two classes: a standard size skid steer and a mini-skid steer. In a standard size skid steer, the user rides in a caged seat surrounded by control levers, knobs and pedals. In a mini-skid steer, the user generally rides on the back of the machine in a standing position. Mini-skid steers also generally have less horsepower and hydraulic fluid flow, thereby allowing them to operate smaller work implements. One problem associated with differing skid steer sizes is that a work implement manufactured for a mini-skid steer does not fit on a standard size skid steer mounting plate and vice versa. Moreover, often times work implements available for one size skid steer is not available for the other size skid steer.

SUMMARY OF THE INVENTION

The present invention recognizes and addresses considerations of prior art constructions and methods. In one embodiment of the present invention, a portable vacuum implement for use with a skid steer vehicle has a frame, a skid steer mounting saddle coupled to the frame and a motor mounted to the frame. A vacuum pump mounted on the frame is coupled to the motor so that the motor drives the vacuum pump. A collection tank mounted on the frame is coupled to the vacuum pump so that the vacuum pump pulls a vacuum through the collection tank. A vacuum head is connected to the collection tank by a first hose for vacuuming debris at an excavation site.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
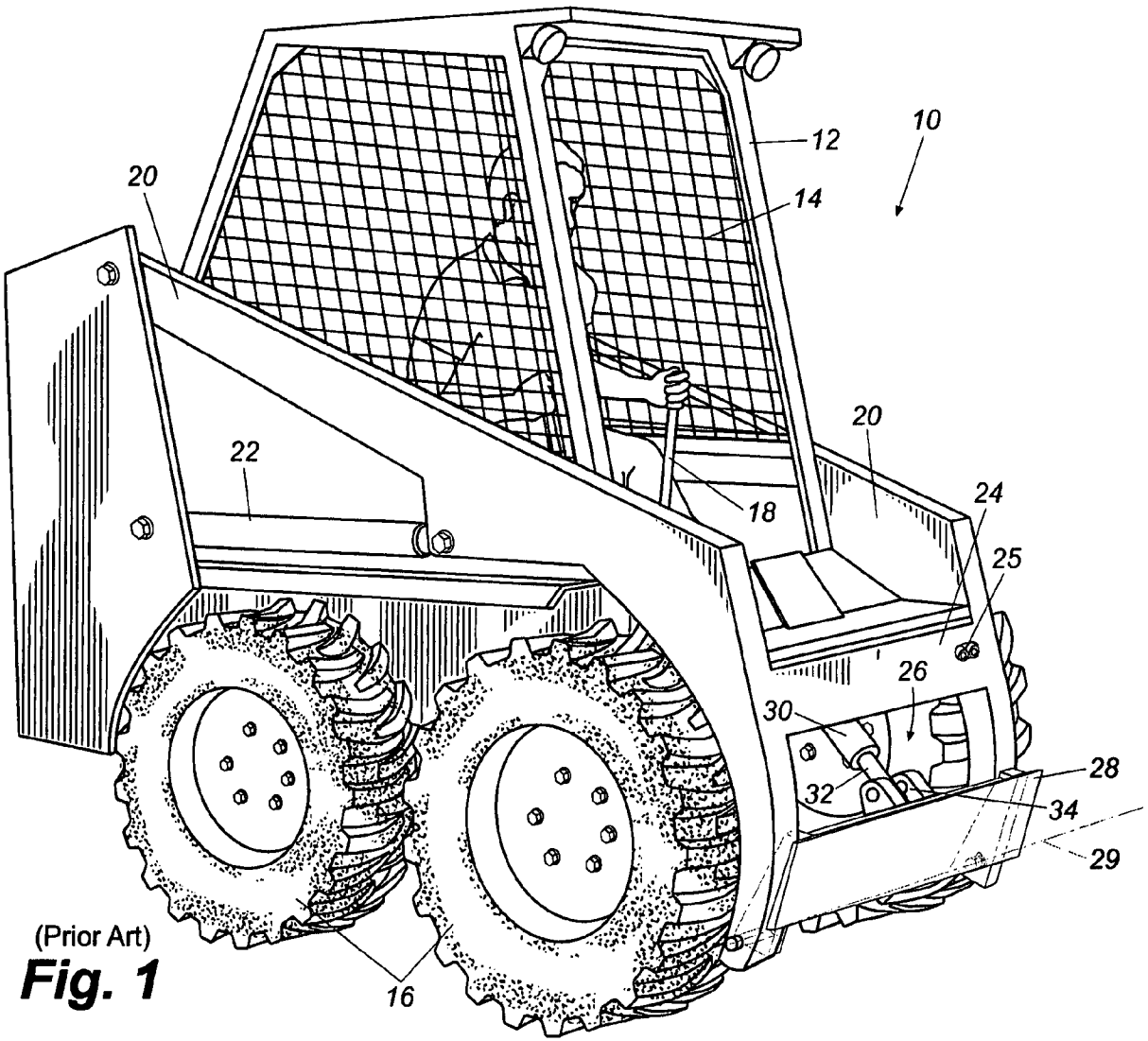
(Prior Art) Fig. 1
FIG. 1 is a perspective view of a prior art standard size skid steer.

Repeat use of reference characters in the present specification and drawings is intended to represent same or analogous features or elements of the invention.

DETAILED DESCRIPTION

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

FIG. 1 illustrates a prior art standard size skid steer 10. It should be understood that skid steer 10 is illustrated for discussion purposes only and is representative of various styles of standard size skid steer vehicles. Thus, any standard size skid steer vehicle having a universal mounting plate is contemplated by this invention. It should be understood in this art that a standard sized skid steer is one that has a rated operating load up to 3600 pounds.

Skid steer 10 includes a chassis 12 that defines an operator's compartment 14. Skid steer 10 preferably uses a conventional hydrostatic transmission with four independently driven wheels 16. The transmission is operated by two steering hand levers 18 (only on of which is shown in the figure). Chassis 12 supports two pivotal lift booms or arms 20 that are raised and lowered by a pair of hydraulic lift cylinders 22. A cross brace 24 connects arms 20 in front of operator compartment 14. A pivot assembly 26 is pivotally mounted to the front end of lift arms 20 and includes a universal mounting plate 28, which is adapted to carry a work implement. Mounting plate 28 is sized and shaped to fit a standard size mounting saddle 202 (FIG. 5B). Most skid steer work implements for standard size skid steers have a mounting saddle 202 for securing the work implement to the skid steer.

A hydraulic pivot cylinder 30 has an extendible rod 32 connected between mounting plate 28 and a pivot point between arms 20 by a clevis 34. Hydraulic pivot cylinder 30 tilts mounting plate 28 about a horizontal axis 29. The lift and pivot cylinders are operated by two foot pedals (not shown) located within the operator compartment. As should be understood by one of ordinary skill in the art, mounting plate 28 carries a locking mechanism such as a spring loaded pin arrangement or over-center lever arrangement that locks the various work implements to the mounting plate. The locking mechanism is not shown or described in detail, and any conventional mounting mechanism can be used to secure a work implement in accordance with the invention to mounting plate 28. Two hydraulic connectors 25 mounted on cross brace 24 allow the hydraulic system of a work implement to connect to the hydraulic system of skid steer 10.

Figure 2:
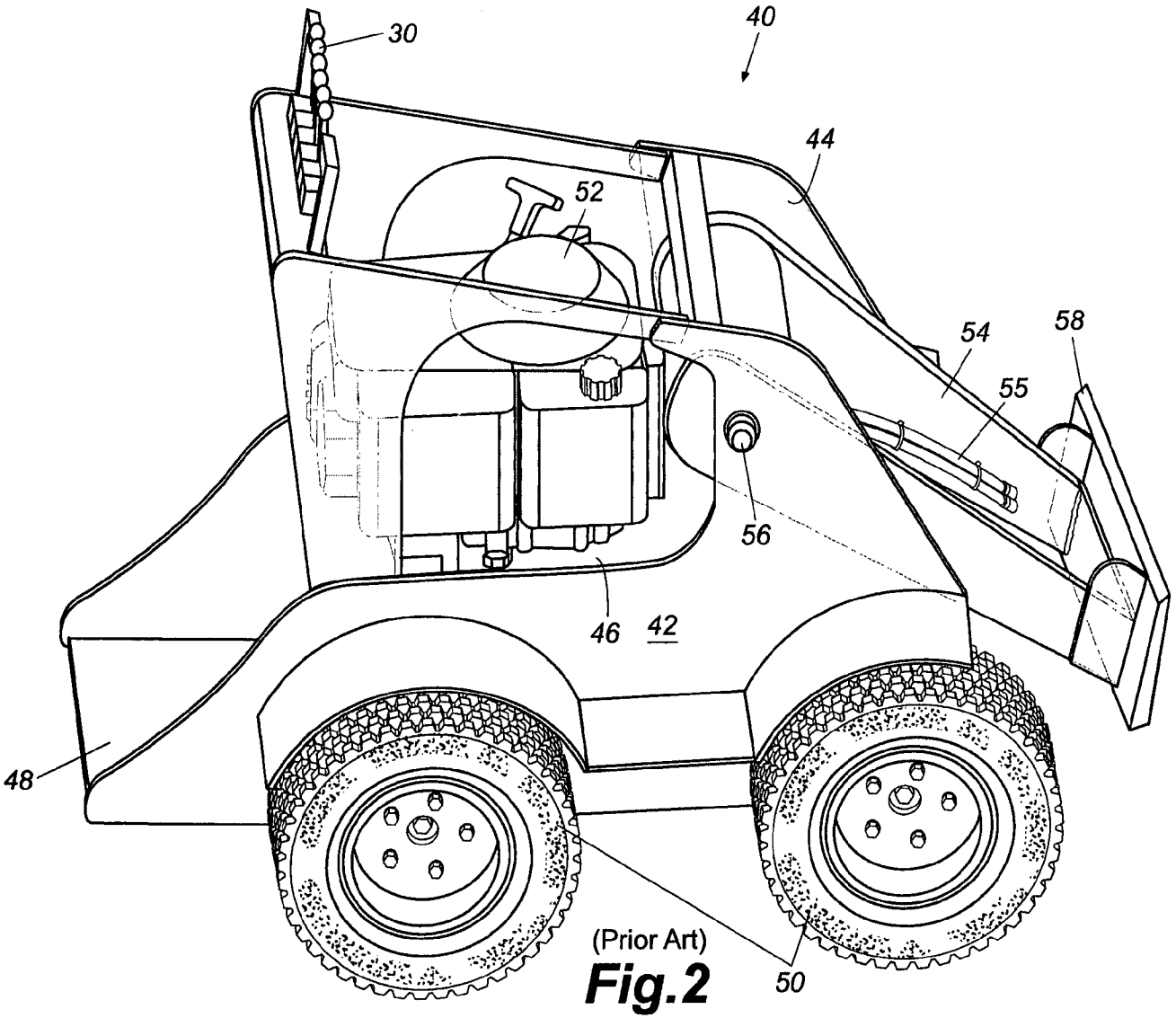
(Prior Art) Fig.2
FIG. 2 is a perspective view of a prior art mini-skid steer.

FIG. 2 illustrates a prior art mini-skid steer 40, in the form of a "mini-loader." It should be understood that mini-skid steer 40 is illustrated for discussion purposes only and is representative of various styles of mini-skid steer vehicles. Thus, any mini-skid steer vehicle having a universal mounting plate is contemplated by this invention. It should be understood in this art that a standard sized skid steer is one that has a rated operating load up to 1250 pounds.

Mini-skid steer 40 has a chassis formed from two spaced apart parallel steel plates 42 and 44 fixed on either side of a metal tank 46. Steel plates 42 and 44 may form the actual sides of tank 46. Tank 46 provides an oil reservoir for the mini-loader's hydraulic drive system and also forms a structural part of the chassis. A tread plate 48 extends between the rear ends of the side plates 42 and 44 and serves as a platform on which the operator stands during the mini-loader's operation. Preferably, tread plate 48 is weighted to act as a counterbalance to the load of a work implement at the front of the mini-skid steer. Mini-skid steer 40 is also provided with two pairs of wheels 50.

A motor 52, typically an internal combustion engine, is mounted to metal tank 46. Motor 52 has a vertical drive shaft that extends downward through tank 46 and engages both a hydraulic pump (not shown) and a transmission system that drives the mini-skid steer in the forward and reverse directions. The hydraulic pump connects to a plurality of control levers 30 that are connected to the remainder of the hydraulic operating system by flexible hoses. The hydraulic operating system controls the upward and downward movement of a boom arm 54 as well as other hydraulic cylinders. Two hydraulic connectors 55 proximate boom arm 54 allow a user to connect a hydraulic system of a work implement to the hydraulic system of mini-skid steer 40.

One end of boom arm 54 is pivotally mounted to a pivot pin 56 that extends between chassis side walls 42 and 44. The other end of boom arm 54 connects to a mounting plate 58. A hydraulic cylinder (not shown), mounted between boom arm 54 and the mini-skid steer chassis is driven by the hydraulic pump to move boom arm 54. Mounting plate 58 is sized and shaped to be received by a mini-skid steer universal mounting saddle 102 (FIG. 4B). Most skid steer work implements that are sized for mini-skid steers contain a mounting saddle 102 for securing the work implement to the mini-skid steer.

One of ordinary skill in the art should understand that a work implement manufactured for a standard size skid steer vehicle will not fit, and cannot be mounted on, mounting plate 58 on mini-skid steer 40. The same is true for mounting plate 28 (FIG. 1) on standard skid steer 10 with respect to a work implement manufactured for a mini-skid steer. That is, mounting saddle 202 (FIG. 5B) will not fit on mini-skid steer mounting plate 58, nor will mini-skid steer mounting saddle 102 (FIG. 4B) fit on standard skid steer mounting plate 28.

Figure 3A:
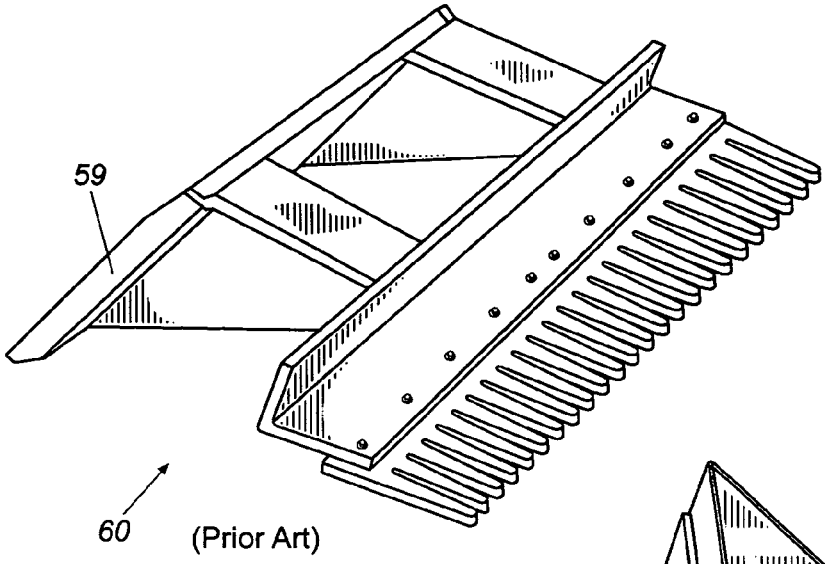
(Prior Art) Fig. 3A
FIGS. 3A-3C are perspective views of prior art skid steer work implements for use with the prior art standard and mini skid steers shown in FIGS. 1 and 2.
Figure 3B:
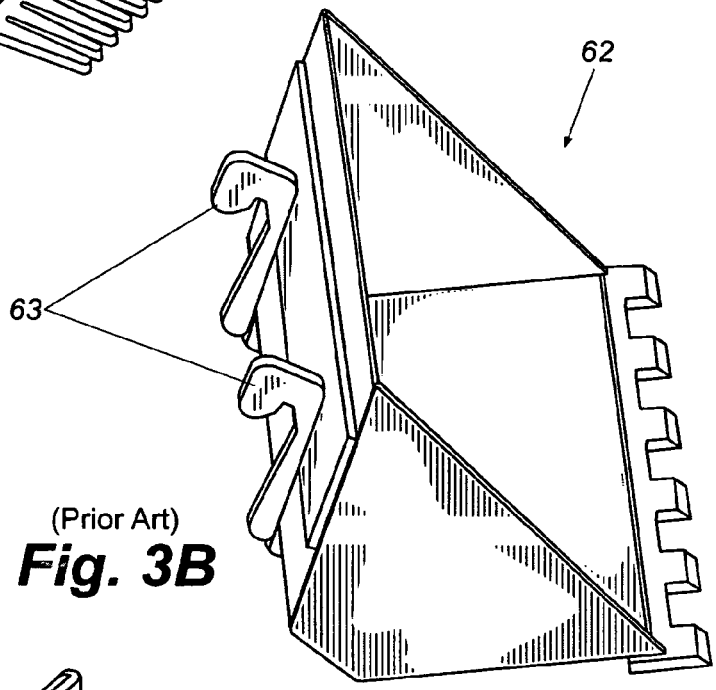
(Prior Art) Fig. 3B
Figure 3C:
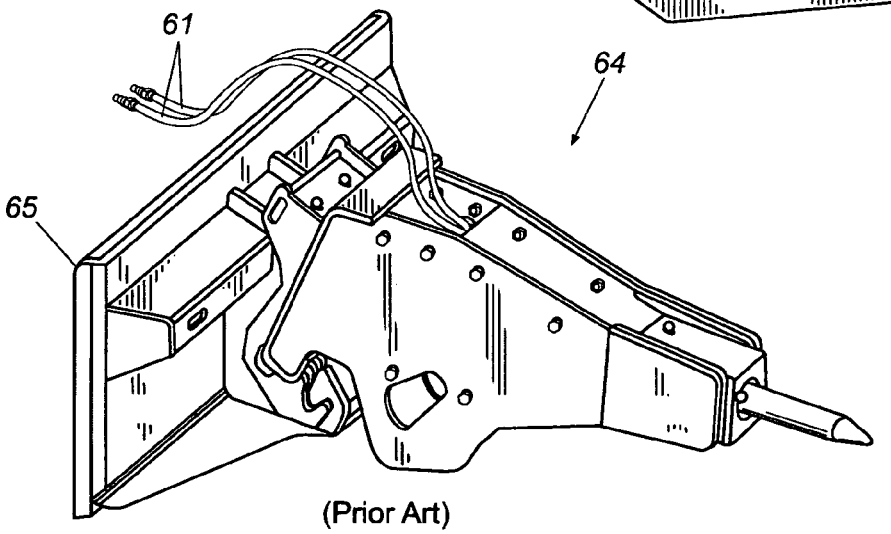
(Prior Art) Fig. 3C

FIGS. 3A-3C illustrate three types of prior art work implements that may be manufactured for use with one of skid steer 10 or mini-skid steer 40. For example, FIG. 3A shows a rake work implement 60; FIG. 3B illustrates a bucket type work implement 62; and FIG. 3C discloses a jackhammer type work implement 64. Rake 60 and bucket 62 are immoveable type work implements in that they have no moveable parts, whereas jackhammer 64 has multiple moveable parts. Thus, jackhammer 64 must connect to the hydraulic system of skid steer 10 or mini-skid steer 40 through hydraulic hoses 61 in order to operate.

For purposes of this discussion, the term "mounting saddle" refers to any type of mounting bracket that allows a work implement to be attached to a universal mounting plate located on either a skid steer or a mini-skid steer vehicle depending on mounting bracket's dimensions. That is, the term "mounting saddle" includes the mounting bracket 59 and 65 shown in FIGS. 3A and 3C, the mounting hooks 63 shown in FIG. 3B, as well any other suitable mounting bracket that couples a work implement to a skid steer vehicle.

Figure 4A:
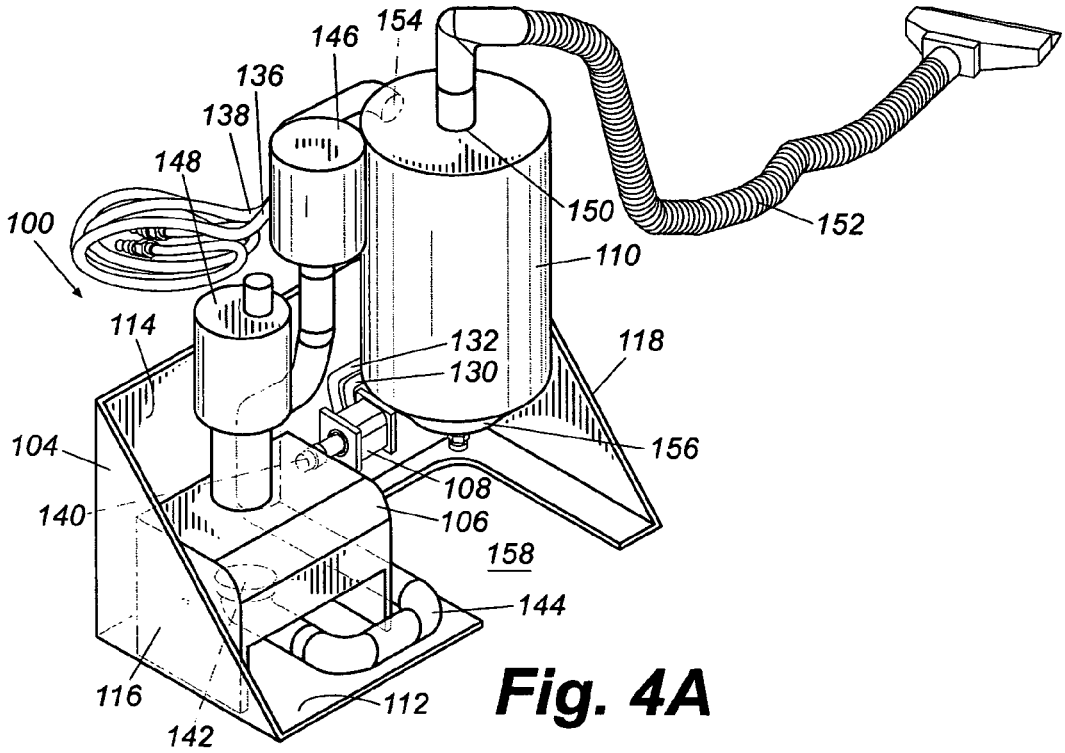
FIGS. 4A-4C are perspective views of a vacuum implement in accordance with an embodiment of the present invention.
Figure 4B:
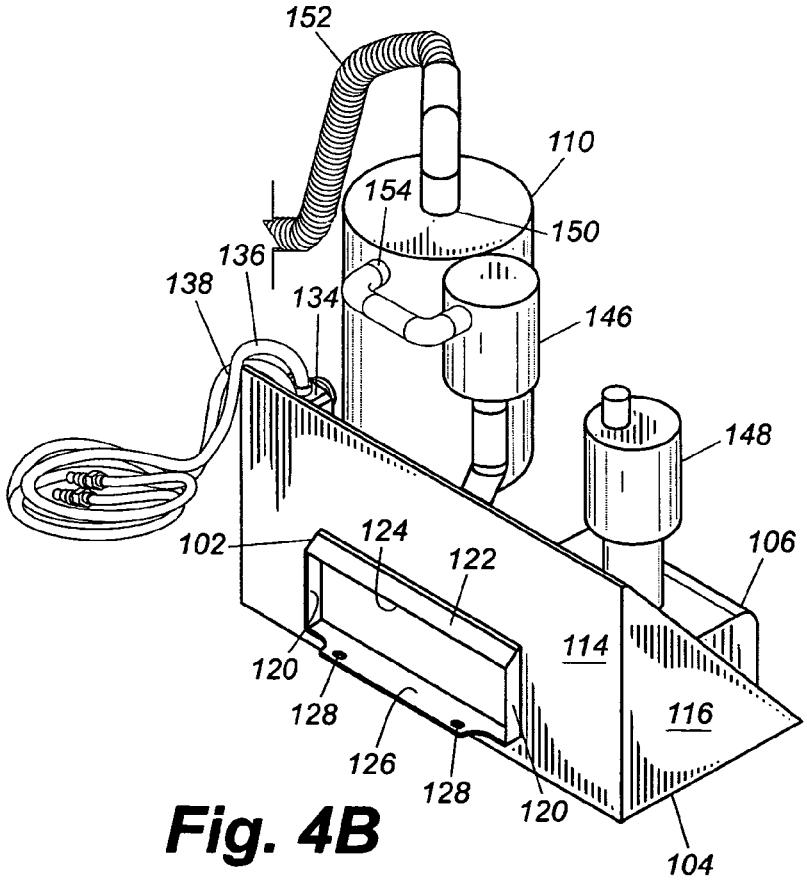
Figure 4C:
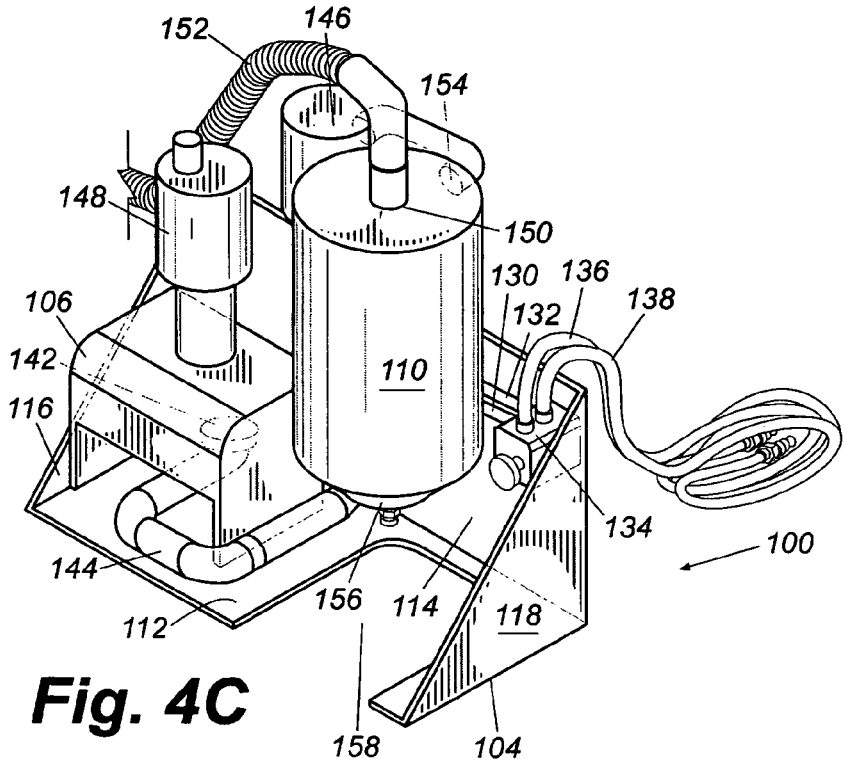

Referring to FIGS. 4A-4C, a vacuum implement 100 has a frame 104, a vacuum pump 106, a hydraulic motor 108 and a collection tank 110. Frame 104 is formed from a base plate 112, a back plate 114 and two opposite side plates 116 and 118 that connect between base plate 112 and back plate 114. A mounting saddle 102 (FIG. 4B) is coupled to back plate 114 by weldments, rivets, bolts, screws or any other suitable attachment means.

Mounting saddle 102 is sized and shaped for use with various models of mini-skid steer vehicle mounting plates, which are approximately 23 inches wide, 9 inches high and 4 inches deep. Mounting saddle 102 includes a pair of side plates 120 connected by a cross member 122. Cross member 122 forms a down turned lip 124 for hooking over the top of mounting plate 58 (FIG. 2). A connection plate 126, connecting the bottom of side plates 120, has a plurality of mounting holes 128. Connection plate 126 conforms to the bottom contour of mounting plate 58. Thus, mounting saddle 102 is sized and shaped to receive mounting plate 58 from mini-skid steer vehicle 40.

During mounting of vacuum implement 100 to mini-skid steer 40, connection plate 126 serves to align mounting saddle 102 with mounting plate 58. Lip 124 engages the upper edge of mounting plate 58, and the back surface of mounting saddle 102 rests flat against the mounting plate's front surface. Mounting saddle 102 is then locked into place against mounting plate 58 by the mini-skid steer's locking mechanism (not shown) located proximate to the bottom of mounting plate 58. The locking mechanism may include pins that engage holes 128, a spring loaded pin arrangement or over-center lever arrangement that locks the various work implements to the mounting plate.

Hydraulic motor 108 is located adjacent to vacuum pump 106 and is attached to back plate 114. Hydraulic motor 108 includes input and output hydraulic hoses 130 and 132 that connect to a hydraulic valve 134 (FIGS. 4B-4C). Hydraulic motor 108 also has an output shaft 140 that is coupled to an input shaft of vacuum pump 106 to drive the vacuum pump. The connection can be a shaft to shaft coupling, sprocket and chain coupling, pulleys and belt coupling or any other suitable coupling.

In the present embodiment, vacuum implement 100 relies on a mini-skid steer hydraulic system that provides 12 gpm of hydraulic fluid flow at a pressure of 2500 psi, which is the equivalent of 17.5 hydraulic horsepower, at the input to valve 134. In a preferred embodiment, hydraulic motor 108 (1) provides 1.02 $in^3$/rev displacement, (2) can handle a maximum hydraulic fluid flow of 18.5 gpm, (3) can handle a maximum fluid pressure of 2500 psi, and (4) outputs a maximum of 3500 rpm. One motor with suitable characteristics is a gear motor Model No. 21305 manufactured by Eaton Hydraulic of Eden Prairie, Minn.

Hydraulic valve 134 has an input hydraulic fluid line 136 and an output hydraulic fluid line 138 that connect to the hydraulic system of mini-skid steer 40 at hydraulic connectors 55 (FIG. 2). In a preferred embodiment, hydraulic valve 134 is a Model S-50 valve manufactured by Gresen, a division of Parker Hannifin Corporation of Elyria, Ohio.

Hydraulic motor 108 drives vacuum pump 106 through output shaft 140 to create suction at an input port 142. Vacuum pump 106 generates a vacuum air flow of approximately 325 cfm at 2500 rpm under no load and approximately 150 cfm at 2500 rpm under a load of approximately 15 inches Hg. One suitable such vacuum pump is a Model No. 4007-Competitor Series vacuum pump manufactured by Tuthill Pneumatics Group of Springfield, Mo.

Intermediate vacuum pump 106 and collection tank 110 is an air filter 146 that cleans air being pulled through collection tank 110 prior to being sucked into vacuum pump 106. Suitable such air filters, for example having a paper plastic filter elements, should be well understood in the art and are therefore not discussed in further detail herein. Such filters are manufactured, for example, by Fleetguard, Inc. of Cookeville, Tenn. and Donaldson Company, Inc. of Minneapolis, Minn. A muffler 148, which should also be understood in this art, attached to vacuum pump 106 muffles the sound produced by vacuum pump 106 when operated. It should be understood that other suitable mufflers and air filters can be used in vacuum implement 100.

Input port 142 connects to a collection tank 110 by a hose 144. Collection tank 110 is generally cylindrical in shape and has an input port 150 that receives a hose 152 and an output port 154 connected to air filter 146. Hose 152 is approximately between two to three inches in diameter to maintain a desired vacuum pressure generated by vacuum pump 106. As the diameter of hose 152 increases over three inches in the illustrated embodiment, the level of suction provided significantly decreases, thereby reducing the efficiency and effectiveness of vacuum implement 100. Vacuum pump 106 creates suction in hose 152 so that water and debris can be removed from the work site through the hose and into collection tank 110.

Collection tank 110 may be emptied by opening a door 156 on an underside of the tank. More specifically, when vacuum implement 100 is coupled to a skid steer 40, the implement can be raised above a large collection bin so that when door 156 is opened, debris from collection tank 110 passes through an opening 158 in base plate 112. Due to its use with a relatively small skid steer or mini-skid steer, vacuum implement 100 may be used at a work site and taken to an access road or other site to empty the collection tank without having to remove the vacuum implement from the skid steer.

Figure 5A:
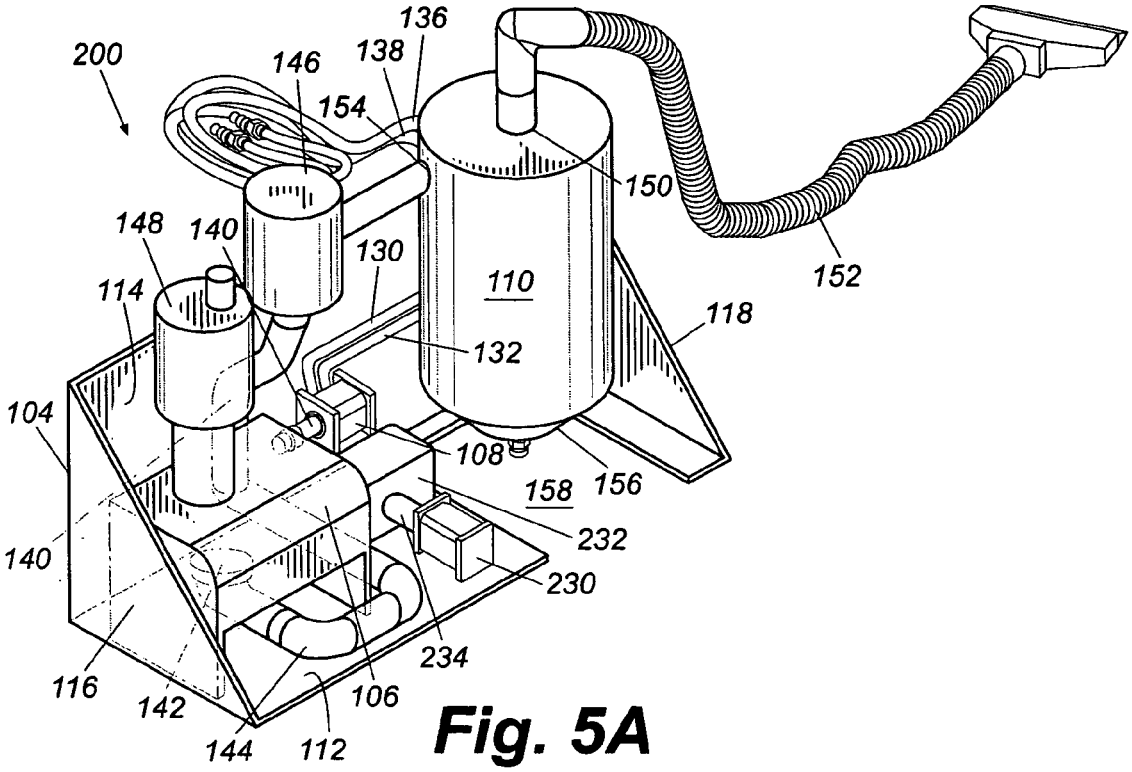
FIGS. 5A-5C are perspective views of a vacuum implement in accordance with an embodiment of the present invention.
Figure 5B:
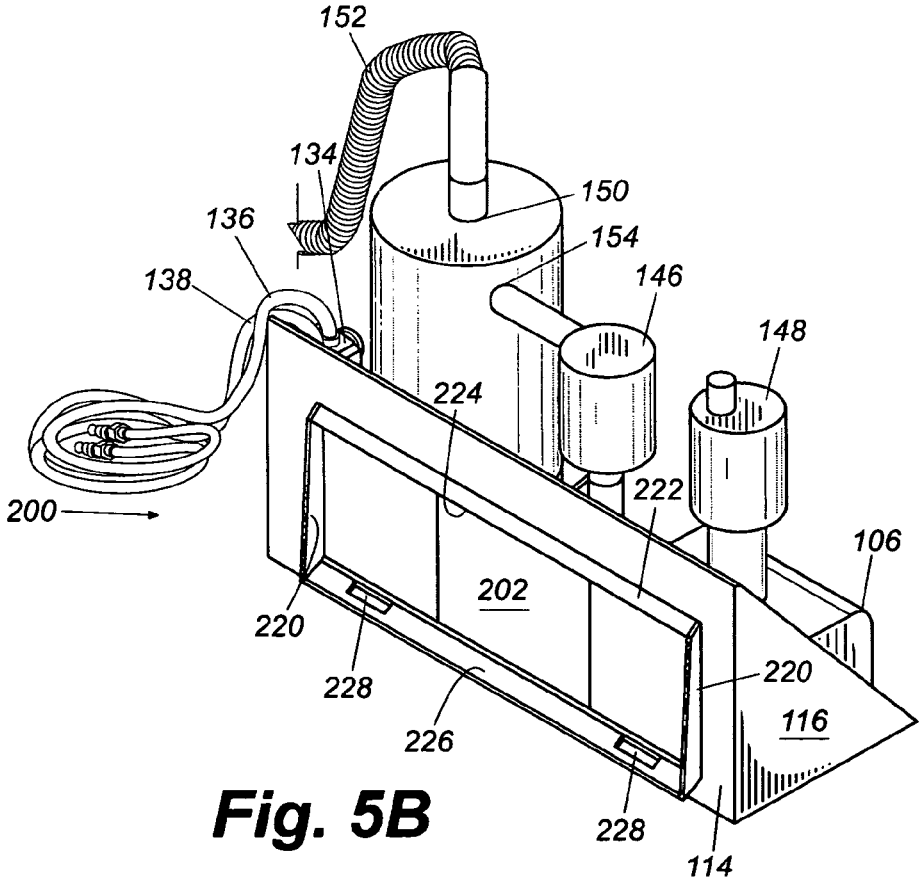
Figure 5C:
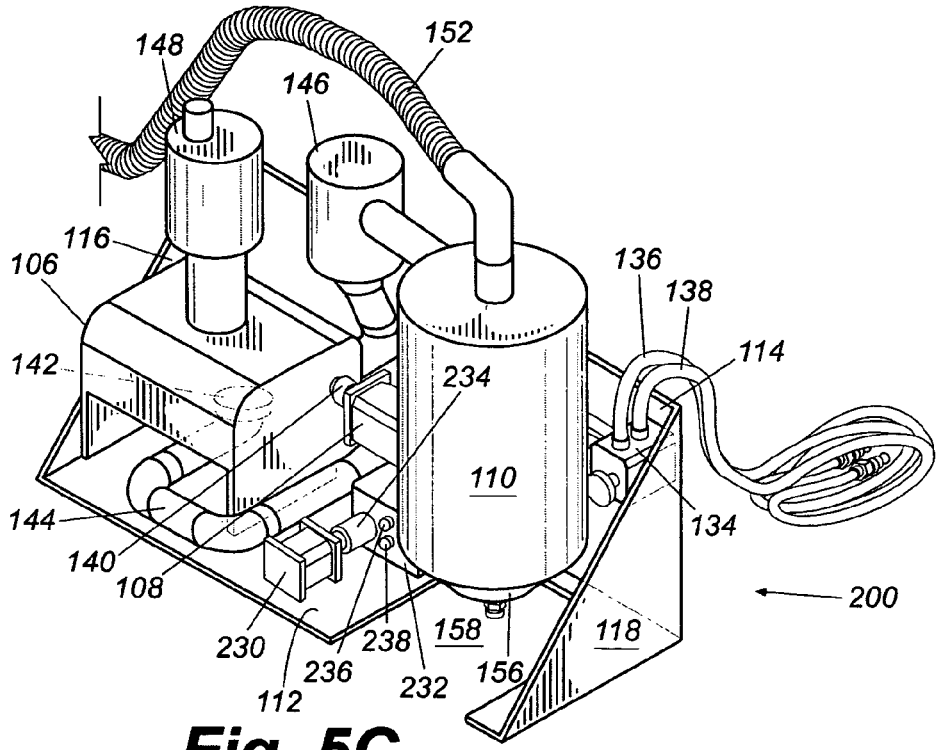

Vacuum implement 200, shown in FIGS. 5A-5C, is similar to vacuum implement 100 except that it also includes a water feature for excavation and/or wash down use. Parts of vacuum implement 200 that are similar to those in implement 100 have been labeled using the same numerical labels that were used in FIGS. 4A-4C, even though the performance specifications may be different. Vacuum implement 200 has a frame 104, a vacuum pump 106, a hydraulic motor 108 and a collection tank 110. Frame 104 is similar to the frame disclosed and described in FIGS. 4A-4C, and a description thereof will not be repeated.

A mounting saddle 202 (FIG. 5B) is coupled to back plate 114 by weldments, rivets, bolts, screws or other suitable means. Mounting saddle 202 is sized and shaped to fit the standard skid steer's mounting plate 28 (FIG. 1), which is approximately 44 inches wide, 17 inches high and 4 inches deep. Mounting saddle 202 includes a pair of side plates 220 connected by a cross member 222. Cross member 222 forms a down turned lip 224 for hooking over the top of mounting plate 28. A connection plate 226, connecting the bottom of side plates 220, has a plurality of mounting slots 228. Connection plate 226 conforms to the bottom contour of mounting plate 28. Thus, mounting saddle 202 is sized and shaped to receive a mounting plate from a standard sized skid steer vehicle. As previously discussed, mounting saddle 202 is sized and shaped to accommodate the mounting plate on skid steer 10, but not the mounting plate on skid steer 40, since mounting plate 58 (FIG. 2) is substantially smaller than that of mounting plate 28 (FIG. 1).

During mounting of vacuum implement 200 to standard skid steer 10, connection plate 226 serves to align mounting saddle 202 with mounting plate 28. Lip 224 engages an upper edge of mounting plate 28, and the back surface of mounting saddle 202 rests flat against the mounting plate's front surface. Mounting saddle 202 is then locked into place against mounting plate 28 by the skid steer's locking mechanism (not shown) located proximate the bottom edge of mounting plate 28. The locking mechanism may include pins that engage holes 128, a spring loaded pin arrangement or over-center lever arrangement that locks the various work implements to the mounting plate.

Similar to the embodiment shown in FIGS. 4A-4C, vacuum implement 200 includes a hydraulic motor 108 located adjacent to vacuum pump 106 and attached to back plate 114. Hydraulic motor 108 includes input and output hydraulic hoses 130 and 132, respectively that connect to a hydraulic valve 134 (FIGS. 5B-5C). Hydraulic motor 108 also has an output shaft 140 that is coupled to an input shaft of vacuum pump 106 to drive the vacuum pump. The connection can be a shaft to shaft coupling, sprocket and chain coupling, pulleys and belt coupling or any other suitable coupling.

In the present embodiment, vacuum implement 200 relies on a skid steer hydraulic system that provides 20 gpm of hydraulic fluid flow at a pressure of 2500 psi, which is the equivalent of 30 hydraulic horsepower, at the input to valve 134. In a preferred embodiment, hydraulic motor 108 (1) provides 1.77 $in^3$/rev displacement, (2) can handle a maximum hydraulic fluid flow of 25 gpm, (3) can handle a maximum fluid pressure of 2500 psi, and (4) outputs a maximum of 3000 rpm. One motor with suitable characteristics is a gear motor Model No. 21308 manufactured by Eaton Hydraulic of Eden Prairie, Minn.

Hydraulic valve 134 has an input hydraulic fluid line 136 and an output hydraulic fluid line 138 that connect to the hydraulic system of skid steer 10 at hydraulic connectors 25 (FIG. 1). In a preferred embodiment, hydraulic valve 134 is a Model S-50 valve manufactured by Gresen, a division of Parker Hannifin Corporation of Elyria, Ohio.

Hydraulic motor 108 drives vacuum pump 106 through output shaft 140 to create suction at an input port 142. Vacuum pump 106 generates a vacuum air flow of approximately 325 cfm at 2500 rpm under no load and approximately 150 cfm at 2500 rpm under a load of approximately 15 inches Hg. One suitable such vacuum pump is a Model No. 4007—Competitor Series vacuum pump manufactured by Tuthill Pneumatics Group of Springfield, Mo.

Intermediate vacuum pump 106 and collection tank 110 is an air filter 146 that cleans air being pulled through collection tank 110 prior to being sucked into vacuum pump 106. Suitable such air filters, for example, having a paper or plastic elements, should be well understood in the art and are therefore not discussed in further detail herein. Such filters are manufactured, for example, by Fleetguard, Inc. of Cookeville, Tenn. and Donaldson Company, Inc. of Minneapolis, Minn. A muffler 148, which should also be understood in this art, attached to vacuum pump 106 muffles the sound produced by vacuum pump 106 when operated. It should be understood that other suitable mufflers and air filters can be used in vacuum implement 200.

Input port 142 connects to a collection tank 110 by a hose 144. Collection tank 110 is generally cylindrical in shape and has an input port 150 that receives a hose 152 and an output port 154 connected to air filter 146. Hose 152 is approximately between two to three inches in diameter to maintain a desired vacuum pressure generated by vacuum pump 106. As the diameter of hose 152 increases over three inches in the illustrated embodiment, the level of suction provided significantly decreases, thereby reducing the efficiency and effectiveness of vacuum implement 100.

Collection tank 110 may be emptied by opening a door 156 on an underside of the tank. More specifically, when vacuum implement 100 is coupled to a skid steer, the implement can be raised above a large collection bin so that when door 156 is opened, debris from collection tank 110 passes through an opening 158 in base plate 112. Due to its use with a relatively small skid steer or mini-skid steer, vacuum implement 200 may be used at a work site and taken to an access road or other site to empty the collection tank without having to remove the vacuum implement from the skid steer.

Vacuum implement 200 further includes a water feature having a second hydraulic motor 230 that connects to a water pump 232 by a drive shaft 234 (FIG. 5C). Hydraulic motor 230 connects to hydraulic valve 134 by a pair of hydraulic lines (not shown). Motor 108 and motor 230 are connected serially to hydraulic valve 134 to maintain a maximum fluid flow through each motor.

In one preferred embodiment, hydraulic motor 108 (1) provides 2.87 $in^3$/rev displacement, (2) can handle a maximum hydraulic fluid flow of 25 gpm, (3) can handle a maximum fluid pressure of 3000 psi, and (4) outputs a maximum of 2500 rpm. In a preferred embodiment, hydraulic motor 108 is a gear motor manufactured by Eaton Hydraulic of Eden Prairie, Minn. having the above characteristics. Other suitable hydraulic motors include, but are not limited to, piston motors, vane motors or any other suitable hydraulic motor.

Water pump 232 has an input port 236 and an output port 238. Input port 236 connects to a water source such as a garden hose or a mobile water tank. Output port 238 connects to a high pressure hose (not shown) that may be used for various excavation operations such as clean up, wash down, pot holing and water digging. Thus, various tips can be attached to output port 238 depending on the application. In a preferred embodiment, water pump 232 is a Model No. TX1512S17 water pump manufactured by General Pump of Mendota Heights, Minn.

Figure 6:
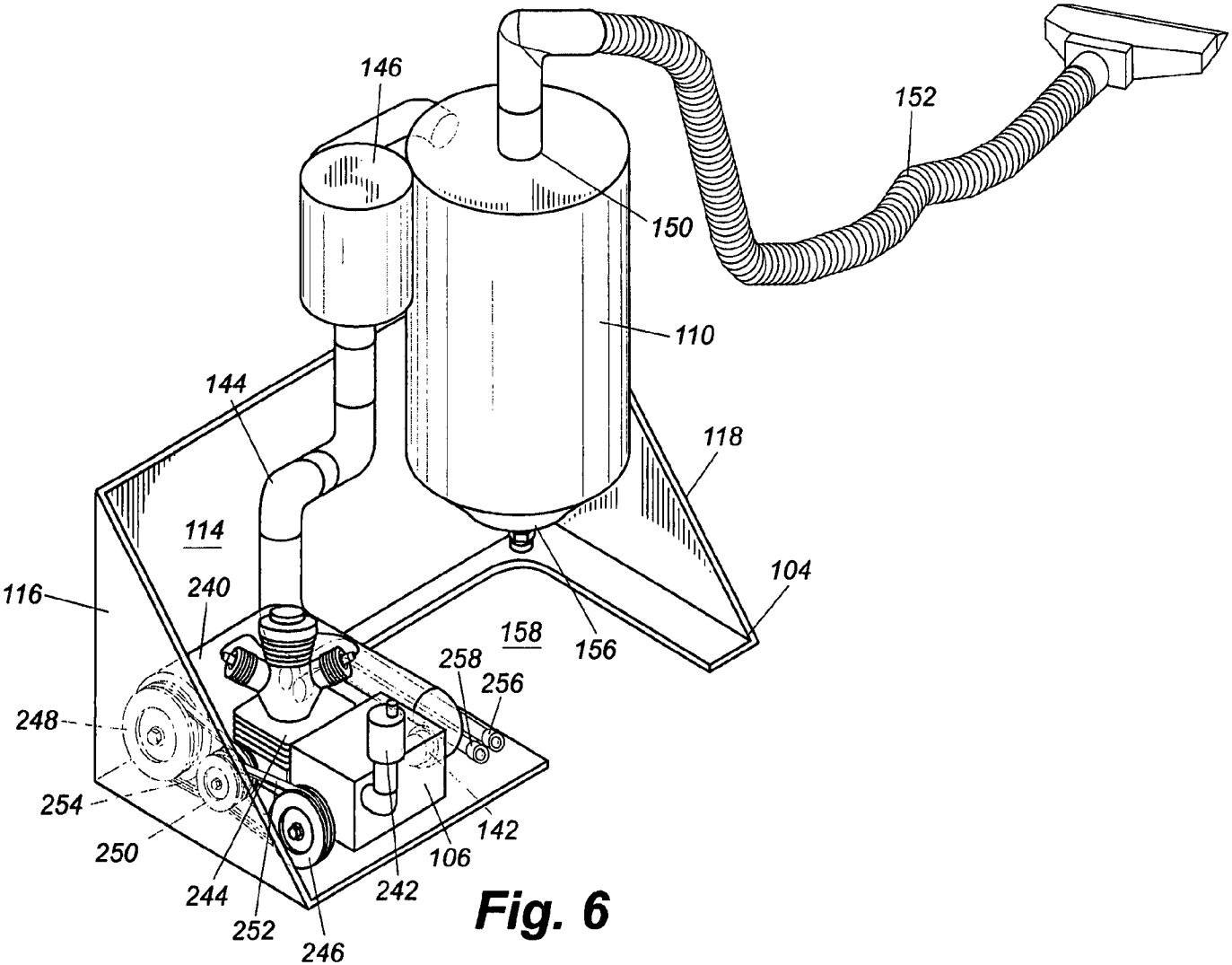
FIG. 6 is a perspective view of a vacuum implement in accordance with an embodiment of the present invention.
Figure 7A:
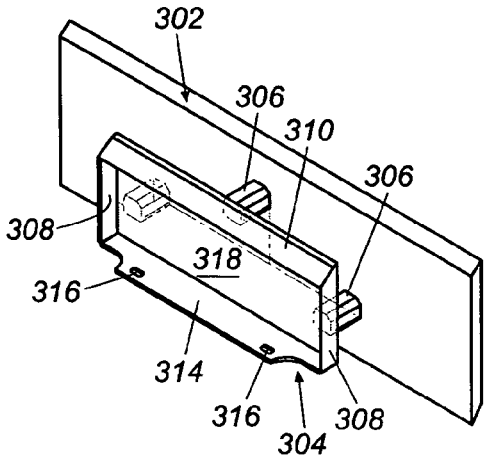
FIGS. 7A-7B are perspective views of a mounting adapter for use with the mini-skid steer of FIG. 2 and the vacuum implement of FIGS. 5A-5C.
Figure 7B:
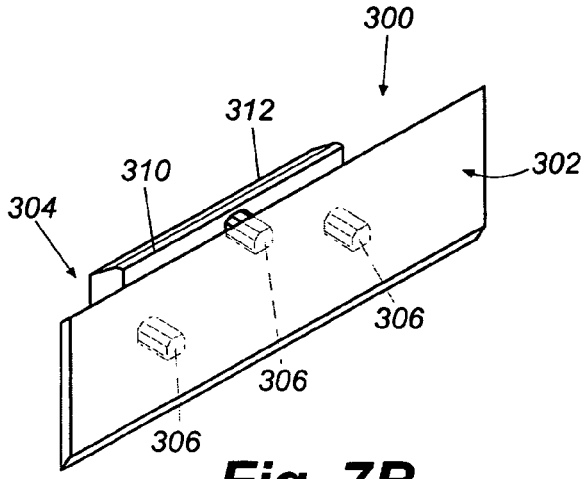
Figure 7C:
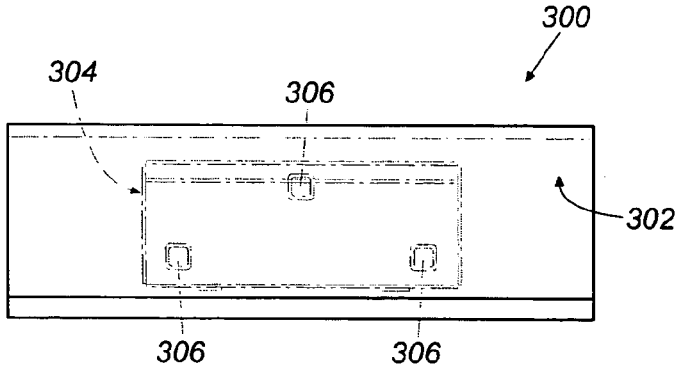
FIG. 7C is a front elevation view of the mounting adapter shown in FIGS. 7A-7B.
Figure 7D:
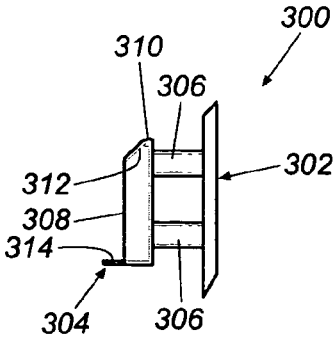
FIG. 7D is a right side elevation view of the mounting adapter shown in FIGS. 7A-7B.
Figure 7E:
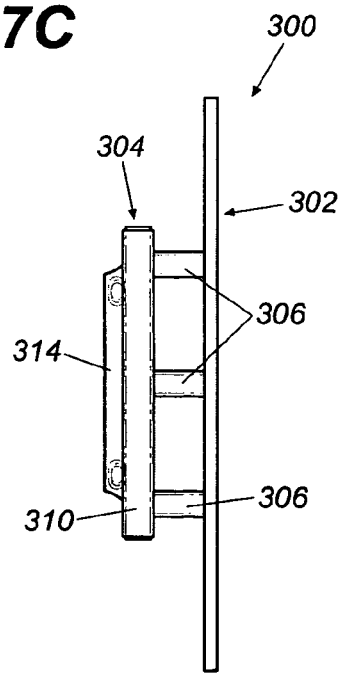
FIG. 7E is a top plan view of the mounting adapter shown in FIGS. 7A-7B.
Figure 8A:
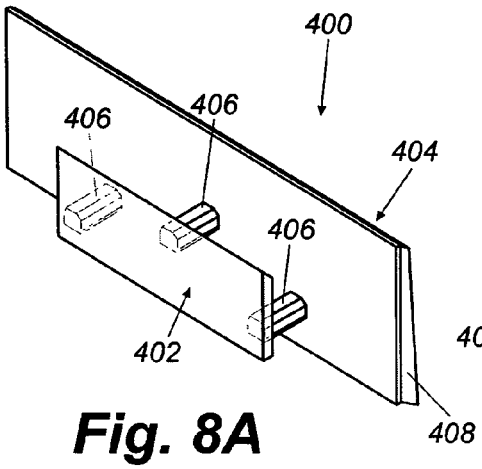
FIGS. 8A-8B are perspective views of a mounting adapter for use with the prior art skid steer of FIG. 1 and the vacuum implement of FIGS. 4A-4C.
Figure 8B:
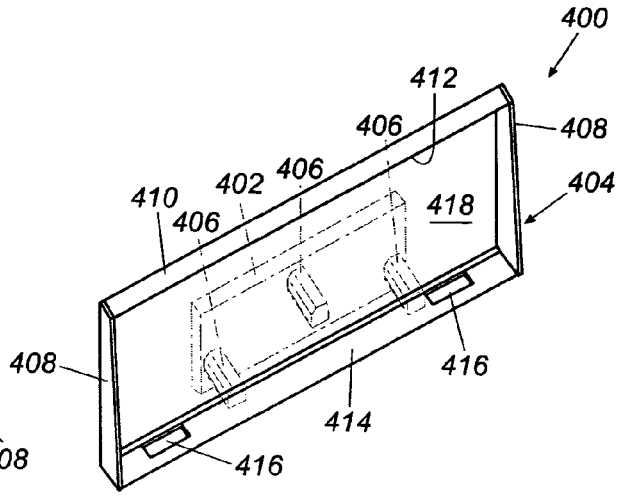
Figure 8C:
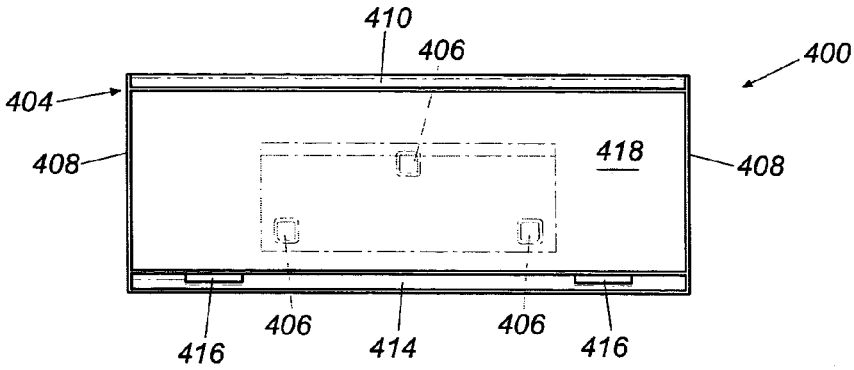
FIG. 8C is a back elevation view of the mounting adapter shown in FIGS. 8A-8B.
Figure 8D:
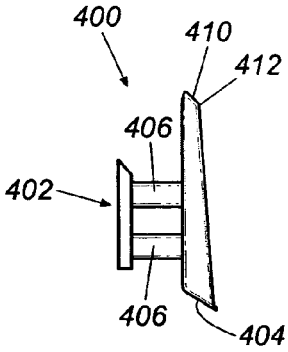
FIG. 8D is a left side elevation view of the mounting adapter shown in FIGS. 8A-8B.
Figure 8E:
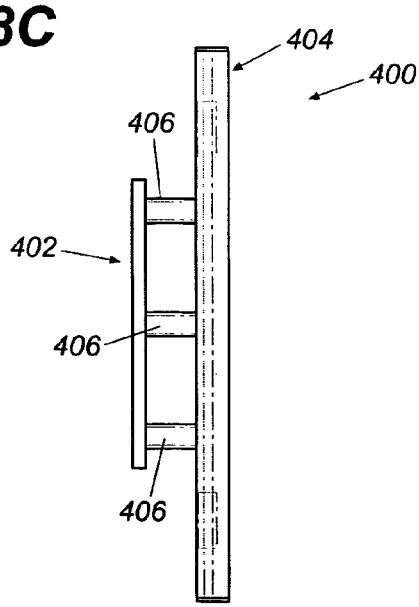
FIG. 8E is a top plan view of the mounting adapter shown in FIGS. 8A-8B.

FIG. 6 illustrates an alternate embodiment of the vacuum implement shown in FIGS. 5A-5C. In particular, frame 104, vacuum pump 106, collection tank 110, hose 152 and air filter 146 are similar to those components in vacuum implement 200. Hydraulic motors 208 and 230, however, have been replaced by a single internal combustion motor 244. An output shaft 250 of motor 244 connects to vacuum pump 106 and water pump 240 by respective belts 252 and 254 that are received by respective pulleys 246 and 248. Thus, in the illustrated embodiment, motor 244 drives both the vacuum and water pumps. A water input port 256 may be connected to a garden hose, water tank or other water source, and a high pressure water output port 258 may be connected to various nozzles for digging, washing, etc. The operation of the internal combustion motor driven implement is substantially the same as the vacuum implement 202 and will not be repeated herein.

Work implements made for a mini-skid steer are sometimes not available with a mounting saddle that fits a standard sized skid steer, and vice versa. Additionally, work implements are expensive and bulky, and as a result, a user might not purchase duplicate work implements for use with different sized skid steers. To alleviate these problems, a mounting adapter 300 illustrated in FIGS. 7A-7E allows a mini-skid steer to utilize a work implement sized for a standard sized skid steer.

Mounting adapter 300 includes a mounting plate 302 and a mounting saddle 304. Mounting plate 302 is connected to mounting saddle 304 by three blocks 306 coupled to a front face of mounting saddle 304 and a back face of mounting plate 302 by weldments or other suitable connecting means such as bolts or screws. Mounting plate 302 is sized and shaped to be received by the type of mounting saddle illustrated on vacuum implement 200 (FIGS. 5A-5C). Mounting plate 302 also has two standard locking mechanisms (not shown) that are well known in the art that engage slots 228 on mounting saddle 202. The locking mechanism may include pins that engage holes 128, a spring loaded pin arrangement or over-center lever arrangement that locks the various work implements to the mounting plate.

Mounting saddle 304 is sized and shaped to fit various models of mini-skid steer vehicles. Mounting saddle 304 includes a pair of side plates 308 connected by a cross member 310. Cross member 310 forms a down turned lip 312 for hooking over the top of a mini-skid steer mounting plate. A connection plate 314 connecting the bottom of side plates 308 has a plurality of mounting holes 316. Connection plate 314 conforms to the contour of the mini-skid steer mounting plate. Thus, mounting saddle 304 is sized and shaped to receive a mounting plate from any type of mini-skid steer vehicle.

Use of mounting adapter 300 will be described with reference to coupling the standard sized vacuum implement 200 to mini-skid steer 40. It should be understood that the mounting adapter illustrated in FIGS. 7A-7C allows any standard sized work implement to be coupled to any mini-skid steer vehicle, provided that the mini-skid steer hydraulic system can adequately run any hydraulic systems that may be present on the standard sized work implement.

Figure 5D:
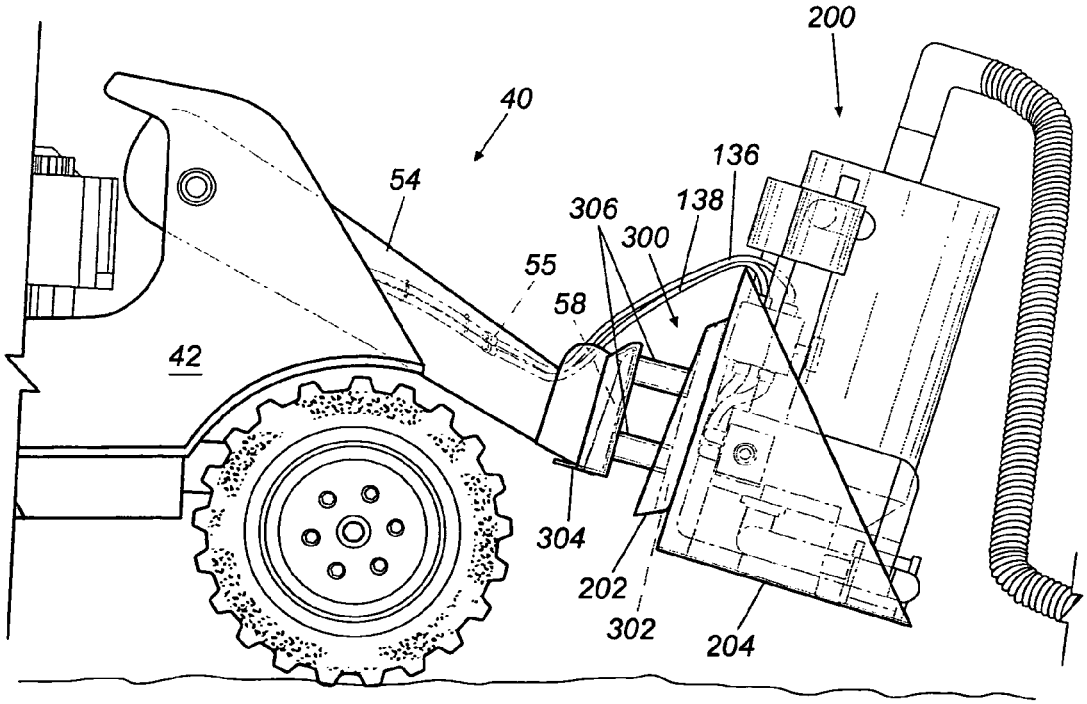
FIG. 5D is a partial side elevation view of the mini-skid steer as shown in FIG. 2 having the vacuum implement of FIGS. 5A-5C attached using the mounting adapter of FIGS. 7A-7E.

Referring to FIG. 5D, when connecting mounting adapter 300 to mini-skid steer 40, connection plate 314 serves to align mounting saddle 304 with mounting plate 58. Lip 312 engages the upper edge of mounting plate 58, and a back surface 318 of mounting saddle 304 rests flat against the mounting plate's front surface. Mounting adapter 300 is then locked into place against mounting plate 58 by the skid steer's locking mechanism (not shown) located on mounting plate 58. The locking mechanism may include pins that engage holes 128, a spring loaded pin arrangement or over-center lever arrangement that locks the various work implements to the mounting plate. Once mounting adapter 300 is in place, adapter mounting plate 302 is inserted into mounting saddle 202 of vacuum implement 200 in the same manner as adapter mounting saddle 304 is inserted on mounting plate 58.

Referring to FIGS. 8A-8D, a mounting adapter 400 is shown that allows a standard sized skid steer to utilize a work implement sized for a mini-skid steer. Mounting adapter 400 includes a mounting plate 402 and a mounting saddle 404. Mounting plate 402 is connected to mounting saddle 404 by three blocks 406 welded to a front face of mounting saddle 404 and a back face of mounting plate 402 by weldments or other suitable connecting means such as bolts or screws.

Mounting plate 402 is sized and shaped to be received by a mounting saddle sized for a mini-skid steer Mounting plate 402 also has two standard locking mechanisms (not shown) that are well know in the art that engage slots on the work implement mounting saddle. The locking mechanism may include pins that engage holes 128, a spring loaded pin arrangement or over-center lever arrangement that locks the various work implements to the mounting plate.

Mounting saddle 404 includes a pair of side plates 408 connected by a cross member 410. Cross member 410 forms a down turned lip 412 for hooking over the top of a skid steer mounting plate. A connection plate 414, connecting the bottom of side plates 408, has a plurality of mounting holes 416. Connection plate 414 conforms to the contour of the skid steer mounting plate. Mounting saddle 404 is sized and shaped to receive a mounting plate from any standard sized skid steer vehicle.

Use of mounting adapter 400 will be described with reference to coupling the mini-skid steer vacuum implement 100 (FIGS. 4A-4C) to skid steer 10 (FIG. 1). It should be understood that the mounting adapter illustrated in FIGS. 8A-8C allows most mini-skid steer sized work implements to be coupled to most standard sized skid steer vehicles.

Figure 4D:
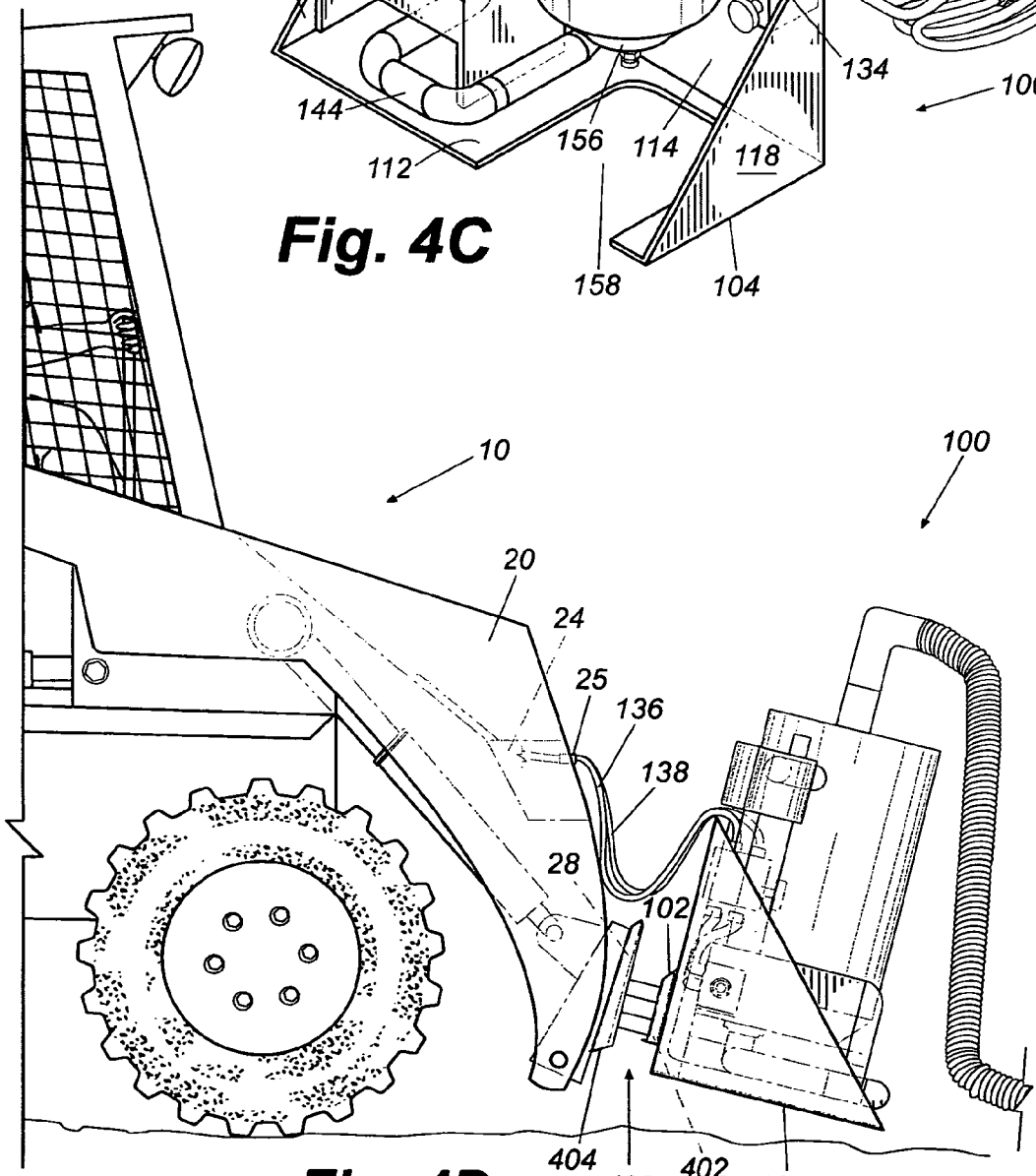
FIG. 4D is a partial side elevation view of the skid steer as shown in FIG. 1 having the vacuum implement of FIGS. 4A-4C attached using the mounting adapter of FIGS. 8A-8E.

Referring to FIG. 4D, when connecting mounting adapter 400 to skid steer 10, connection plate 414 serves to align mounting saddle 404 with mounting plate 28. Lip 412 engages the upper edge of mounting plate 28, and a back surface 418 of mounting saddle 404 rests flat against the mounting plate's front surface. Mounting adapter 400 is then locked into place against mounting plate 28 by the skid steer's locking mechanism (not shown) located on mounting plate 28. The locking mechanism may include pins that engage holes 128, a spring loaded pin arrangement or over-center lever arrangement that locks the various work implements to the mounting plate. Once mounting adapter 400 is in place, adapter mounting plate 402 is inserted into mounting saddle 102 of vacuum implement 100 in the same manner as adapter mounting saddle 404 is inserted on mounting plate 28.

Figure 9:
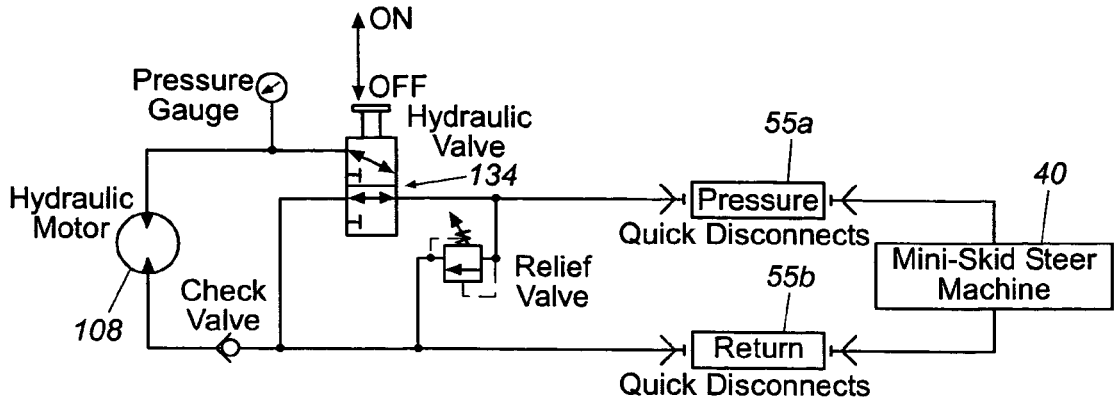
FIG. 9 is a schematic of a hydraulic system for the vacuum implement of FIGS. 4A-4C.
Figure 10:
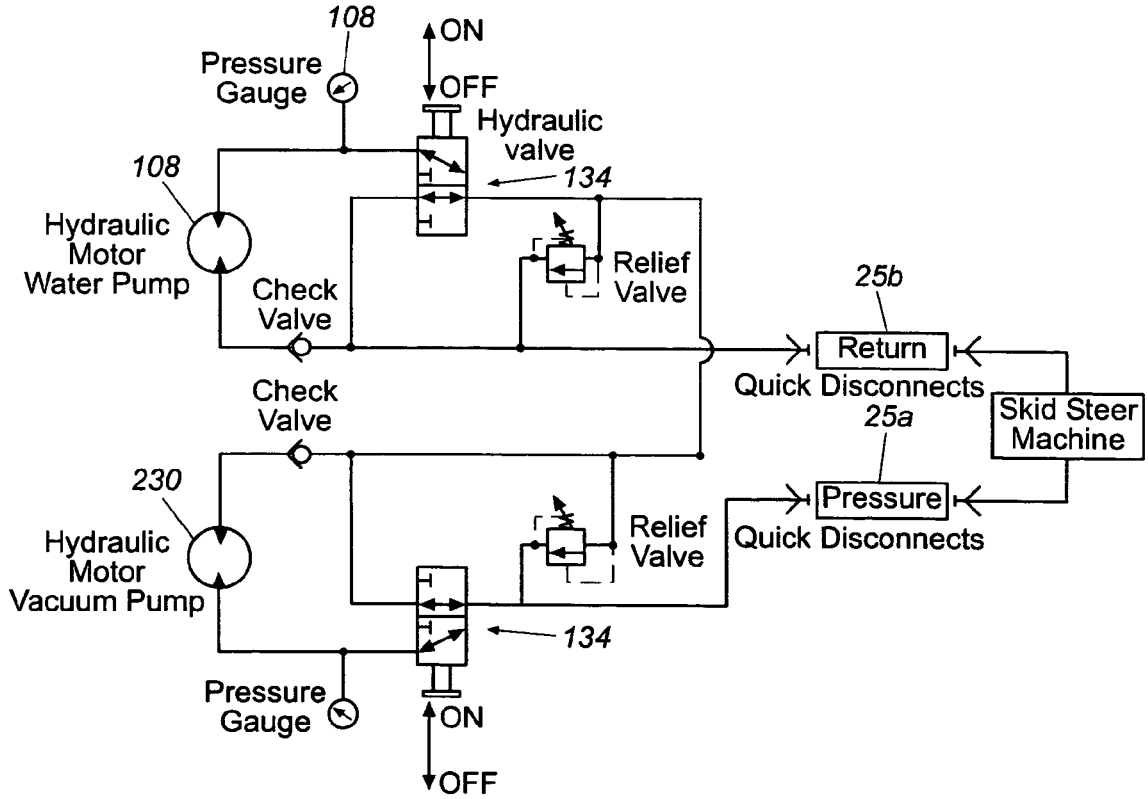
FIG. 10 is a schematic of a hydraulic system for the vacuum implement of FIGS. 5A-5C.

FIGS. 9 and 10 illustrate a hydraulic schematic for each of the mini-skid steer vacuum implement 100 (FIGS. 4A-4C) and the standard sized vacuum implement 200 (FIGS. 5A-5C), respectively. FIG. 9 illustrates that hydraulic output 55*a* of mini-skid steer 40 connects to input port 136 of hydraulic valve 134. Hydraulic valve 134 regulates the flow of hydraulic fluid through hydraulic motor 108. A hydraulic output of motor 108 connects to hydraulic input 55*b* of mini-skid steer 40. As a result, an operator can control the speed of hydraulic motor 108 through the mini-skid steer's hydraulic system.

With reference to FIG. 10, the work implement's hydraulic system connects to the standard skid steer's hydraulic system through input port 25*a* and output port 25*b*. Hydraulic motor 108 connects serially with hydraulic motor 230 so as to maintain the maximum fluid flow through each motor. That is, if the motors were instead connected in parallel, the fluid flow through each motor would be half of the available fluid flow thereby reducing the effectiveness and efficiency of the motors. Thus, the difference between the hydraulic system of the work implement illustrated in FIGS. 4A-4C and the work implement illustrated in FIGS. 5A-5C is the additional hydraulic motor needed to drive the water pump. This difference, however, requires more horsepower to run vacuum implement 200 as compared to vacuum implement 100.

Referring to FIGS. 11A-11F, a mounting adapter 500 is shown that allows a standard sized skid steer to utilize a work implement sized for a mini-skid steer. Mounting adapter 500 includes a mounting frame 502 and a mounting saddle 504. A back surface of mounting frame 502 is coupled to a front surface of mounting saddle 504 by two brackets 506. The connection can be made by weldments or any other suitable connecting means such as bolts or screws.

Mounting frame 502 is sized and shaped to be received by a work implement having a mini-skid steer mounting saddle similar to that illustrated in FIG. 4B. Mounting frame 502 also has two standard locking mechanisms 505 that are well know in the art and that engage slots on the work implement mounting saddle. In one preferred embodiment, locking mechanisms 505 include spring loaded pins that engage holes 128 in mounting saddle 102 (FIG. 4B). Other locking mechanisms may also be used, for example an over-center lever arrangement that locks the various work implements to the mounting plate.

Mounting frame 502 includes a slanted top rail 508, opposing side walls 510 and 512, and a bottom rail 514. The rails and side walls may be attached by weldments or other suitable connecting means such as bolts, screws, or rivets. Brackets 516 that house spring loaded pins 505 also provide adequate support between the top and bottom rails 508 and 514. The frame defined by the top and bottom rails and the side walls effectively works the same as plate 402 in FIG. 8A but weighs less.

Figure 11A:
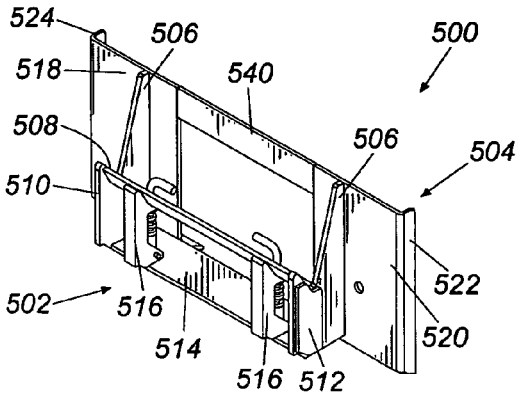
FIG. 11A-11B are perspective views of a mounting adapter for use with the prior art skid steer of FIG. 1.
Figure 11B:
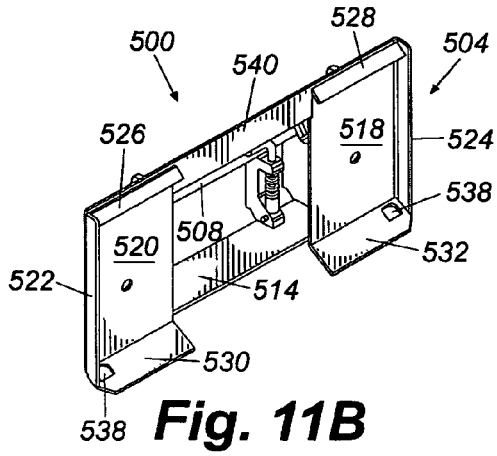
Figure 11C:
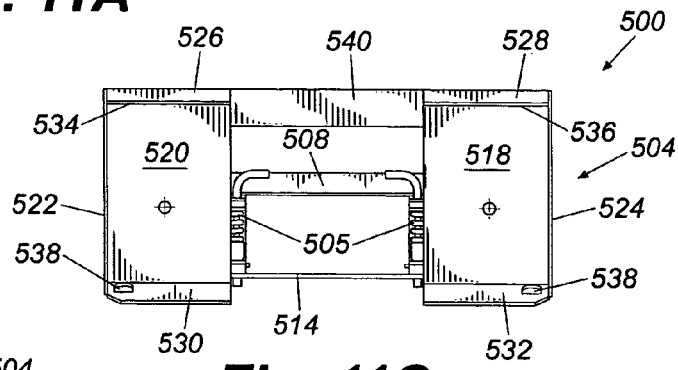
FIG. 11C is a back elevation view of the mounting adapter shown in FIGS. 11A-11B
Figure 11D:
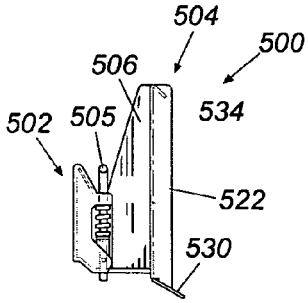
FIG. 11D is a left side elevation view of the mounting adapter shown in FIGS. 11A-11B.
Figure 11E:
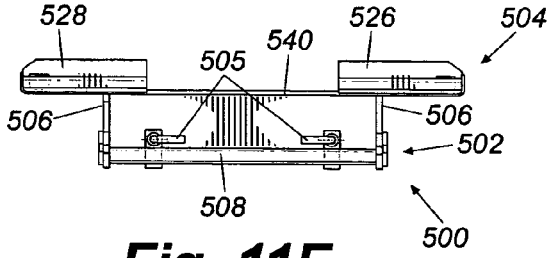
FIG. 11E is a top plan view of the mounting adapter shown in FIGS. 11A-11B.
Figure 11F:
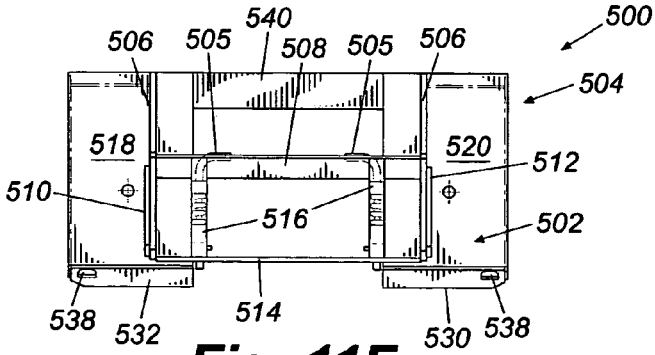
FIG. 11F is a front elevation view of the mounting adapter shown in FIGS. 11A-11B.

Referring to FIGS. 11B and 11C, mounting saddle 504 includes a pair of back plates 518 and 520, side plates 522 and 524, top cross members 526 and 528 and bottom cross members 530 and 532. Cross members 526 and 528 form downward turned lips 534 and 536 (FIG. 11C) for hooking over the top of a skid steer mounting plate. Bottom cross members 530 and 532 each connect to the bottom of respective side plates 522 and 524 and have a mounting hole 538 formed therein. A top cross member 540 connects between back plates 518 and 520. Mounting saddle 504 is sized and shaped to receive a mounting plate from any standard sized skid steer vehicle, such as the skid steer vehicle illustrated in FIG. 1.

It should be understood that a similar construction can be used to adapt a mini-skid steer to a standard sized work implement. That is, the construction of FIGS. 11A-11F can be changed to provide an adapter that functions similar to that shown in FIGS. 7A-7F by resizing mounting frame 502 and mounting saddle 504.

Referring to FIGS. 12A-12E, a vacuum implement 600 generally has a collection tank 602, a vacuum pump 604, a hydraulic motor 606 and a cyclonic separator 608. Collection tank 602 is formed from a base plate 610, a back plate 612, a top plate 614, a front door 616, and two opposite side plates 618 and 620 that attach to base plate 610, back plate 612 and top plate 614. The sides, back, top and base plates all connect by weldments or other means of attachment.

Figure 12A:
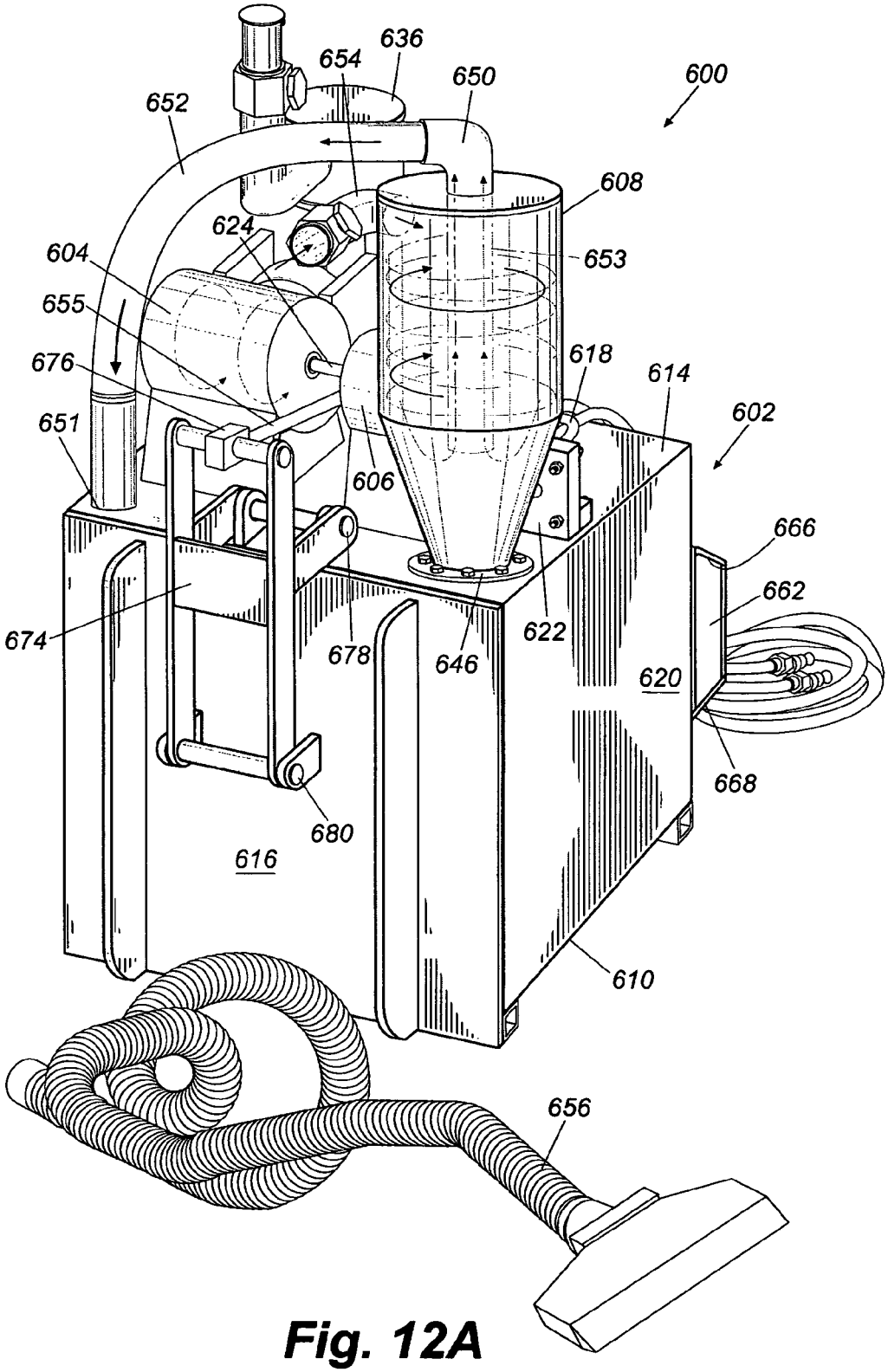
FIGS. 12A-12C are perspective views of a vacuum implement in accordance with an embodiment of the present invention.
Figure 12B:
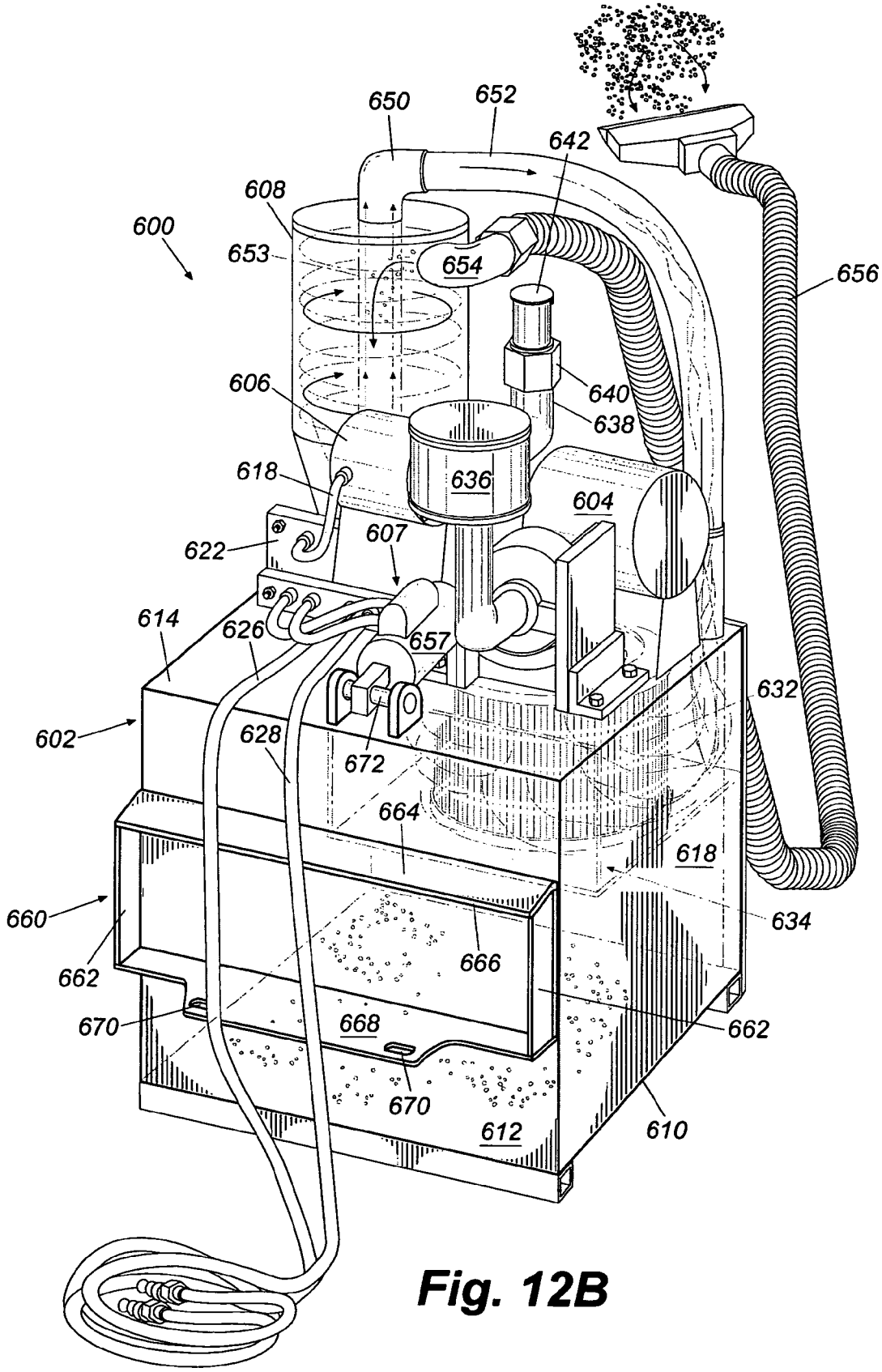

Hydraulic motor 606 is located adjacent to vacuum pump 604 and is attached to top plate 614. Hydraulic motor 606 includes input and output hydraulic hoses 618 and 620 (FIG. 12E) that connect to a hydraulic manifold 622 (FIGS. 12B and 12E). Hydraulic motor 606 also has an output shaft 624 that is coupled to an input shaft of vacuum pump 604 to drive the vacuum pump. The connection can be a shaft to shaft coupling, sprocket and chain coupling, pulleys and belt coupling or any other suitable coupling.

In the present embodiment, vacuum implement 600 relies on a mini-skid steer hydraulic system that provides 12 gpm of hydraulic fluid flow at a pressure of 2500 psi, which is the equivalent of 17.5 hydraulic horsepower, at the input to manifold 622. In one preferred embodiment, hydraulic motor 606 (1) provides 0.88 $in^3$/rev displacement, (2) can handle a maximum hydraulic fluid flow of 15.0 gpm, (3) can handle a maximum fluid pressure of 3500 psi, and (4) outputs a maximum of 3000 rpm. One motor with suitable characteristics is a gear motor Model No. SNM2/14C106E manufactured by Sauer-Danfoss of Easley, S.C.

Referring to FIGS. 12B and 12E, hydraulic manifold 622 has an input hydraulic fluid line 626 and an output hydraulic fluid line 628 that connect to the hydraulic system of mini-skid steer 40 at hydraulic connectors 55 (FIG. 2). In a preferred embodiment, hydraulic manifold 622 includes (1) control valves to turn motor 606 on and off and to control fluid flow to a hydraulic cylinder 607 and (2) pressure relief valves. It should also be understood that each of these components can be separately mounted on implement 600 and can be connected by a plurality of hoses, as is well known in the industry.

Hydraulic motor 606 drives vacuum pump 604 through output shaft 624 to create suction at an input port 630 (FIG. 12E) formed in top plate 614. Vacuum pump 604 generates a vacuum air flow of approximately 305 cfm at 3000 rpm under no load and approximately 230 cfm at 3000 rpm under a load of approximately 12 inches Hg. One suitable such vacuum pump is a Model No. 3006-Competitor Series vacuum pump manufactured by Tuthill Pneumatics Group of Springfield, Mo.

Figure 12C:
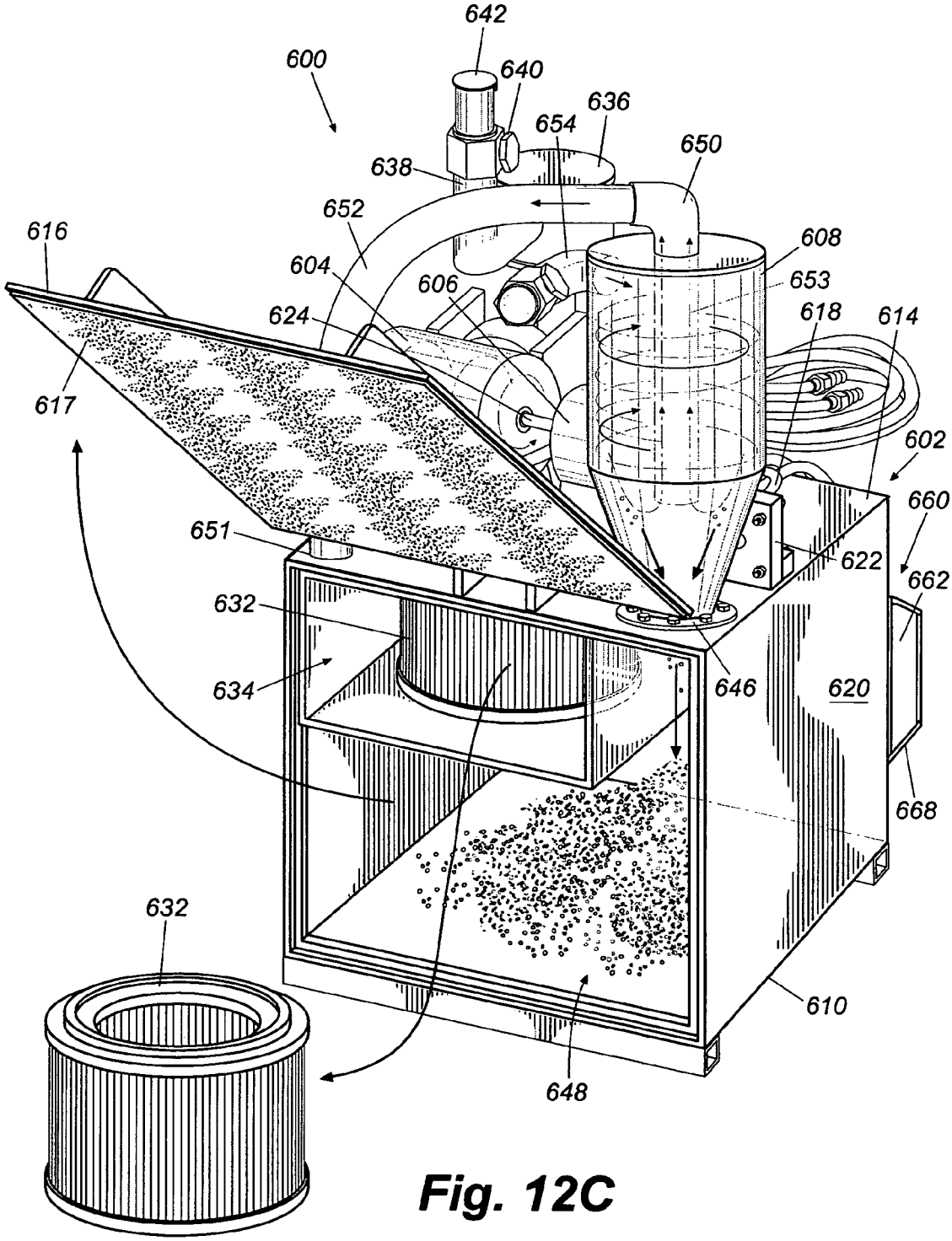
Figure 12E:
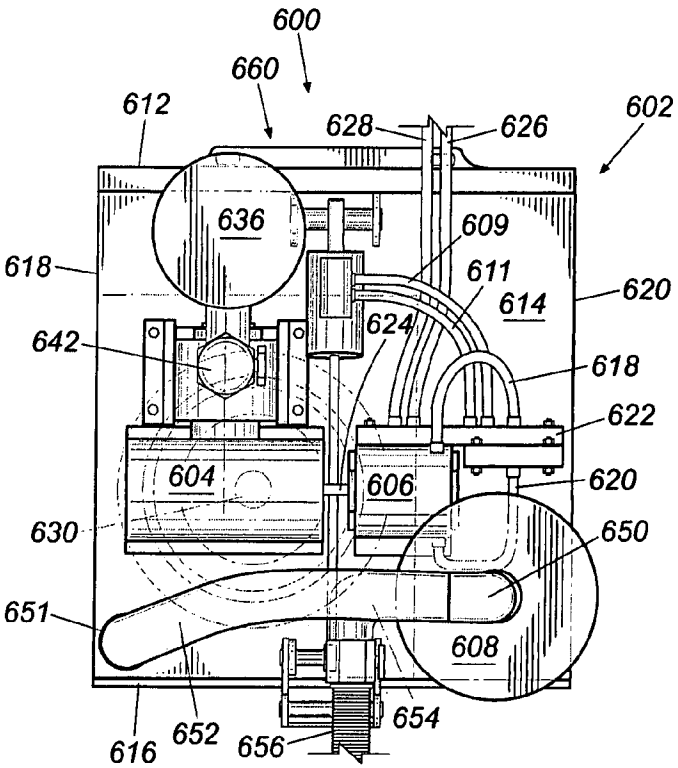
FIG. 12E is a top view of the vacuum implement of FIG. 12A.

Referring to FIG. 12C, intermediate input port 630 and cyclonic separator 608 is an air filter 632 that filters air being pulled from cyclonic separator 608 into vacuum pump 604. Air filter 632 is located within collection tank 602 in a filter chamber 634. The location of filter chamber 632 allows the filter to be cleaned when collection tank 602 is being emptied of debris and water. Typically, a pleated washable media filter of at least a 2 to 5 micron rating is used. Such filters are manufactured, for example, by Fleetguard, Inc. of Cookeville, Tenn. and Donaldson Company, Inc. of Minneapolis, Minn.

Figure 12D:
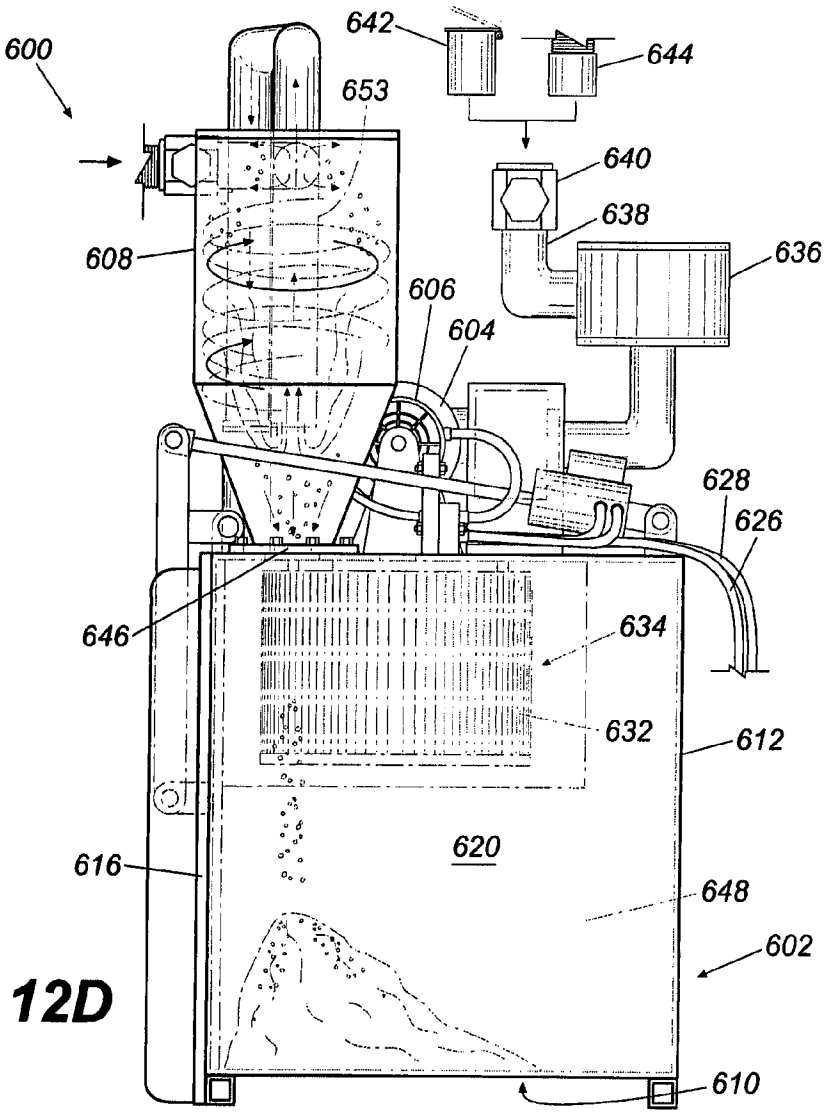
FIG. 12D is a side elevation view of the vacuum implement of FIG. 12A.

A muffler 636, which should also be understood in this art, attached to vacuum pump 604 muffles the sound produced by vacuum pump 604 when operated. A ninety degree elbow 638 couples a connector 640 to muffler 636. Suitable connectors include strap connectors, detent connectors and, in one preferred embodiment, a banjo accordion connector. Referring to FIG. 12D, a rain cap 642 may be coupled to connector 640 when implement 600 is run in the vacuum mode. If vacuum implement 600 is to be used in a reverse blower mode, a hose 644 may be coupled to connector 640 to provide a centralized blowing force through the hose. Hose 644 may be the same hose coupled to an input port of the cyclonic separator or may be a separate hose having a smaller diameter to increase the velocity of the blown air. It should be understood that other suitable mufflers can be used in vacuum implement 600.

Referring to FIGS. 12A, 12C and 12D, cyclonic separator 608 mounts on collection tank 602 at the front left corner so that a first output port 646 drops dirt and debris into a main chamber 648 (FIG. 12C) in collection tank 602. A second output port 650 connects to filter chamber 634 at 651 by a hose 652 outside of filter 632. A cylindrical tube 653 extends downward from port 650 into cyclonic separator 608 and ends proximate port 646. An input port 654 on cyclonic separator 608 connects to a hose 656. Hose 656 is approximately between two to three inches in diameter to maintain a desired vacuum pressure generated by vacuum pump 604. As the diameter of hose 656 increases over three inches in the illustrated embodiment, the level of suction provided significantly decreases, thereby reducing the efficiency and effectiveness of vacuum implement 600. Vacuum pump 604 creates suction in hose 656 so that water and debris can be removed from the work site through the hose and cyclonic separator and into collection tank 602.

Collection tank 602 may be emptied by opening front door 616 by activating hydraulic cylinder 607. More specifically, when vacuum implement 600 is coupled to a skid steer 40, the hydraulic cylinder is operated by hydraulic fluid provided through hydraulic lines 609 and 611 from hydraulic manifold 622. The fluid flow is activated by a control valve in manifold 622 that causes a rod 655 (FIG. 12A) to be retracted into a base cylinder 657 (FIG. 12B). Base cylinder 657 is pivotally coupled to top plate 614 at 672 (FIG. 12B), and rod 655 is pivotally connected to a handle 674 at 676 (FIG. 12A). Handle 674 pivotally connects to top plate 614 at 678 and pivotally connects to front door 616 at 680. Thus, as rod 655 is retracted into hydraulic base cylinder 657, the door pivots about point 678, causing the lower end of the door to swing upward, as shown in FIG. 12C. Once opened, debris in collection tank chamber 648 may be removed and filter 632 may be cleaned.

The opening to collection tank 602 may have a seal located thereabout to help maintain a vacuum seal when front door 616 is closed. In one preferred embodiment, a seal 617 (FIG. 12C) is affixed to the inside surface of the door so that the door seats against the edges of the top, bottom, and opposing side plates and also against the edges of the open portion of filter chamber 634 so that filter chamber 634 is sealed off from the main collection tank chamber 648. It should be understood that various types of seal material may be used, including, but not limited to, vinyl, rubber, metal alloy, or various polymers. In the configuration described above, the vacuum air stream pulled through filter chamber 634 does not pass through collection chamber 648 since the filter chamber is sealed off from the collection chamber.

In operation, and referring to FIGS. 12A and 12B, motor 606 rotationally drives vacuum pump 604 through drive shaft 624. Vacuum pump 604 pulls a vacuum air stream through filter chamber 634 at port 630 (FIG. 12E). The air stream pulled through filter 632 in filter chamber 634 draws an air stream-through hose 652 from cyclonic separator 608. The cyclonic separator draws a debris laden air stream from hose 656 into the separator.

The cyclonic separator mechanically separates the incoming liquid and solid debris from the air stream. The debris laden air stream enters the cyclonic separator tangentially through input port 654 and circles radially around the cyclonic separator cylindrical housing. As the air circulates, centrifugal force pushes the liquid and solid particles to the outside of the air stream. Outlet tube 653 is located vertically inside the cyclonic separator housing with its inlet port positioned a specified distance down in the housing. Radial airflow driven down through the housing makes an abrupt 180 degree turn up outlet tube cylinder 653. Because the dirt and water particles are significantly heavier than the air particles, the dirt and water particles cannot make the 180 degree upturn and eventually fall downward through port 646 into the main collection chamber 648. The air stream pulled up through outlet tube 653 may still contain micro particles of dirt and debris. Thus, the air stream is directed through hose 652 into filter chamber 634. Consequently, the filter separates the micro particles from the air stream, and the filtered air is pulled through vacuum pump 604 and expelled through muffler 636 out rain cap 642.

A mounting saddle 660 (FIG. 12B) is coupled to back plate 612 by weldments, rivets, bolts, screws or any other suitable attachment means. Mounting saddle 660 is sized and shaped for use with various models of mini-skid steer vehicles that contain a mounting plate approximately 23 inches wide, 9 inches high and 4 inches deep. Mounting saddle 660 includes a pair of side plates 662 connected by a cross member 664. Cross member 664 forms a down turned lip 666 for hooking over the top of a mounting plate similar to mounting plate 58 (FIG. 2). A connection plate 668, connecting the bottom of side plates 662, has a plurality of mounting holes 670. Connection plate 668 conforms to the bottom contour of mounting plate 58. Thus, mounting saddle 660 is sized and shaped to receive mounting plate 58 from mini-skid steer vehicle 40. It should be understood that mounting plate 660 can also be sized to accept the mounting plate 28 of a standard sized skid steer 10 (FIG. 1).

During mounting of vacuum implement 600 to mini-skid steer 40, connection plate 668 aligns mounting saddle 660 with mounting plate 58. Lip 666 engages the upper edge of mounting plate 58, and the back surface of mounting saddle 660 rests flat against the mounting plate's front surface. Mounting saddle 660 is then locked into place against mounting plate 58 by the mini-skid steer's locking mechanism (not shown) located proximate to the bottom of mounting plate 58. The locking mechanism may include pins that engage holes 670, a spring loaded pin arrangement or over-center lever arrangement that locks the various work implements to the mounting plate.

Because vacuum implement 600 can be used with a relatively small skid steer or mini-skid steer, vacuum implement 600 may be used at a work site and taken to an access road or other site to empty the collection tank without having to remove the vacuum implement from the skid steer.

Figure 13:
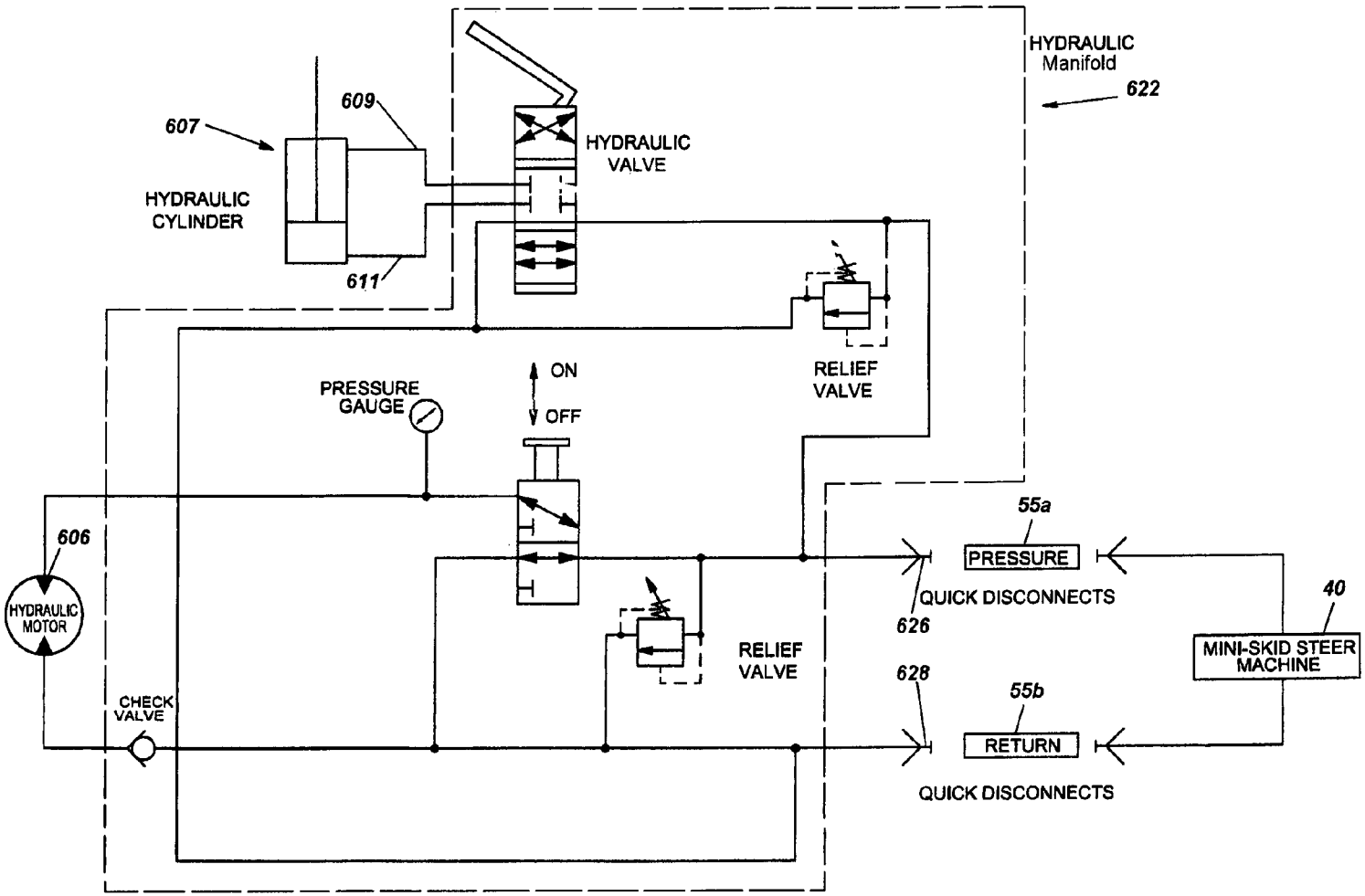
FIG. 13 is a schematic of a hydraulic system for the vacuum implement of FIGS. 12A-12E.

FIG. 13 illustrates a hydraulic schematic for vacuum implement 600 (FIGS. 12A-12E). The figure illustrates that hydraulic output 55*a* of mini-skid steer 40 connects to input port 626 of hydraulic manifold 622. Manifold 622 regulates the flow of hydraulic fluid through hydraulic motor 606. A hydraulic output 628 of manifold 622 connects to hydraulic input 55*b* of mini-skid steer 40. As a result, an operator can control the speed of hydraulic motor 606 and the operation of hydraulic cylinder 607 through the mini-skid steer's hydraulic system.

It should be appreciated by those skilled in the art that various modifications and variations can be made in the present invention without departing from the scope and spirit of the invention. For example, the water feature shown in FIGS. 5A-5C can be employed in the vacuum implement shown in FIGS. 4A-4C and 12A-12E. It is intended that the present invention cover such modifications and variations as come within the scope and spirit of the appended claims and their equivalents.

What is claimed is:

1. A portable vacuum implement for use with a skid steer vehicle comprising:

a. a frame;

b. a skid steer mounting saddle coupled to said frame;

c. a first hydraulic motor mounted to said frame and operatively coupled to a hydraulic system of said skid steer for powering said first hydraulic motor;

d. a vacuum pump mounted on said frame and coupled to said motor so that said first hydraulic motor drives said vacuum pump;

e. a second hydraulic motor serially coupled to said first hydraulic motor;

f. a water pump mounted on said frame and operatively coupled to said second hydraulic motor so that said second hydraulic motor drives said water pump;

g. a hydraulic manifold coupled to said frame and operatively connected between the hydraulic system of the skid steer and one of said first hydraulic motor and said second hydraulic motor, wherein said hydraulic manifold is configured to allow more than one hydraulic motor to operate from the hydraulic system of the skid steer;

h. a collection tank mounted on said frame and coupled to said vacuum pump so that said vacuum pump pulls a vacuum through said collection tank; and i. a vacuum head coupled to said collection tank by a first hose for vacuuming debris at an excavation site.

2. The portable vacuum implement of claim 1, wherein said collection tank further comprises a door for emptying said collection tank.

3. A portable vacuum implement for use with a skid steer vehicle comprising:

a. a frame having, (i) a base plate, (ii) a back plate, and (iii) two opposing side plates connecting between said base plate and said back plate;

b. a skid steer mounting saddle coupled to said frame for mounting said vacuum implement to a skid steer;

c. a hydraulic motor mounted to said frame;

d. a hydraulic manifold mounted to said frame having an input coupled to a hydraulic system of said skid steer and a first output port coupled to an input port of said hydraulic motor, wherein said hydraulic manifold is configured to allow said hydraulic motor to operate after the skid steer power is turned off;

e. a vacuum pump mounted on said frame and coupled to said hydraulic motor so that said motor drives said vacuum pump;

f. a collection tank mounted on said frame and coupled to said vacuum pump so that said vacuum pump pulls a vacuum through said collection tank;

g. a door coupled to said collection tank for emptying said collection tank; and h. a hydraulic cylinder positioned intermediate said collection tank and said door, said hydraulic cylinder being operatively coupled to a second output port of said hydraulic manifold;

wherein said hydraulic manifold provides controls to operate said hydraulic motor and said hydraulic cylinder.

4. The portable vacuum implement of claim 3, further comprising a water pump operatively coupled to a third output of said hydraulic manifold so that said hydraulic manifold operatively controls said water pump.

5. A portable vacuum implement for use with a skid steer vehicle comprising:

a. a hydraulic motor;

b. a vacuum pump coupled to said hydraulic motor so that said motor drives said vacuum pump;

c. a collection tank operatively coupled to said vacuum pump so that said vacuum pump pulls a vacuum through said collection tank, said collection tank having a top wall, a bottom wall and a rear wall;

d. a skid steer mounting saddle coupled to said motor, said vacuum pump and said collection tank;

e. a hydraulic door coupled between said collection tank top wall and bottom wall opposite said rear wall; and f. a hydraulic manifold in operative engagement with said hydraulic motor and said hydraulic door, said hydraulic manifold having an input coupled to a hydraulic system of said skid steer, wherein said hydraulic manifold, said hydraulic motor and said vacuum pump are mounted on said collection tank top wall and said skid steer mounting saddle is mounted on said collection tank rear wall, and said hydraulic manifold provides controls that allow a user to control the operation of said hydraulic motor and said hydraulic door.

* * * * *